US008807217B2

(12) United States Patent
Tunget

(10) Patent No.: US 8,807,217 B2
(45) Date of Patent: Aug. 19, 2014

(54) METHODS FOR USING OR REMOVING UNUSED ROCK DEBRIS FROM A PASSAGEWAY THROUGH SUBTERRANEAN STRATA USING ROCK BREAKING APPARATUS

(76) Inventor: Bruce A. Tunget, Westhill (GB)

( * ) Notice: Subject to any disclaimer, the term of this patent is extended or adjusted under 35 U.S.C. 154(b) by 747 days.

(21) Appl. No.: 12/928,674

(22) Filed: Dec. 16, 2010

(65) Prior Publication Data

US 2011/0146998 A1 Jun. 23, 2011

Related U.S. Application Data

(63) Continuation-in-part of application No. 12/653,784, filed on Dec. 18, 2009, now Pat. No. 8,387,693.

(51) Int. Cl.
*E21B 33/13* (2006.01)

(52) U.S. Cl.
USPC ..... 166/292; 166/285; 175/320

(58) Field of Classification Search
USPC ..... 166/292, 250.1, 285, 242.1; 175/327, 175/320; 384/92; 241/275
See application file for complete search history.

(56) References Cited

U.S. PATENT DOCUMENTS

| | | | | |
|---|---|---|---|---|
| 5,890,537 | A * | 4/1999 | Lavaure et al. | 166/285 |
| 8,387,693 | B2 * | 3/2013 | Tunget | 166/292 |
| 2005/0173119 | A1 * | 8/2005 | Hay et al. | 166/302 |
| 2007/0068704 | A1 * | 3/2007 | Krueger et al. | 175/57 |
| 2008/0128140 | A1 * | 6/2008 | Giroux et al. | 166/381 |
| 2010/0155067 | A1 * | 6/2010 | Tunget | 166/285 |
| 2011/0146998 | A1 * | 6/2011 | Tunget | 166/311 |

* cited by examiner

*Primary Examiner* — Daniel P Stephenson

(57) ABSTRACT

A method for using or removing unused rock debris from a bored passageway through subterranean strata using at least one rock breaking apparatus engaged with a conduit string and placed within the subterranean passageway proximal region, using a member adapted to increase the volume of reduced particle size rock debris generated by increasing the frequency of impact and associated breakage of the rock debris inventory, per revolution of the conduit string and/or per volume of fluid slurry circulated. The used volume of rock debris inventory coats the unlined strata wall of said passageway to inhibit strata fracture initiation or propagation, and the unused rock debris inventory is urged from the passageway at an increased rate by the associated reduction in fluid slurry suspension or velocities needed to urge the rock debris through the unlined strata passageway of improved pressure integrity from inhibiting said initiation or propagation of strata fractures.

11 Claims, 9 Drawing Sheets

Section S-S

Fig. 7
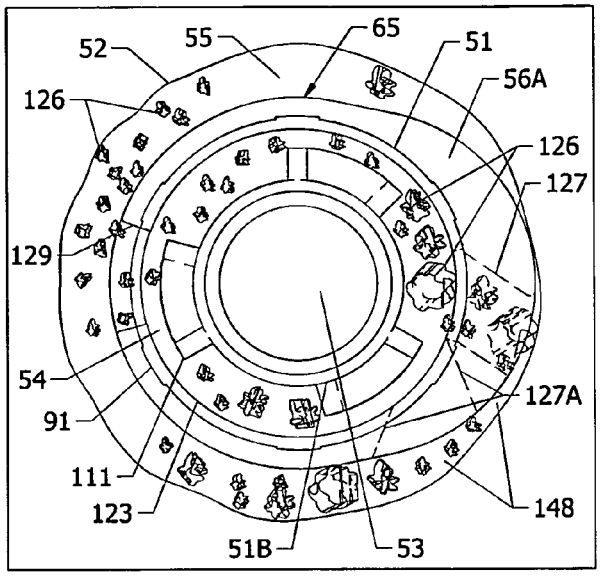
Fig. 5
Prior Art
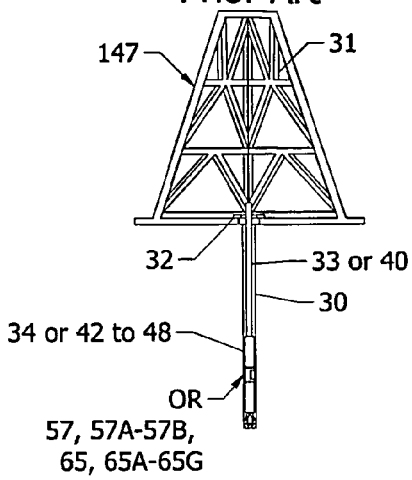
Fig. 8
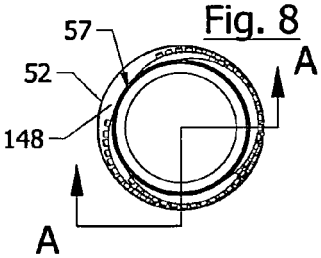
Fig. 10
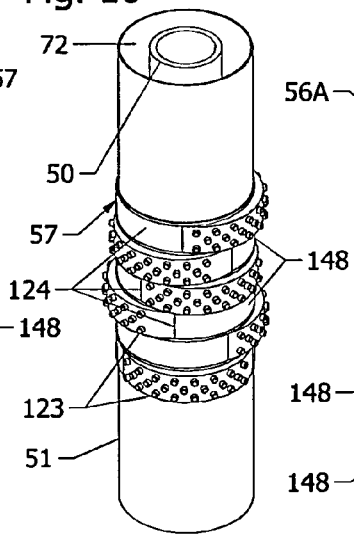
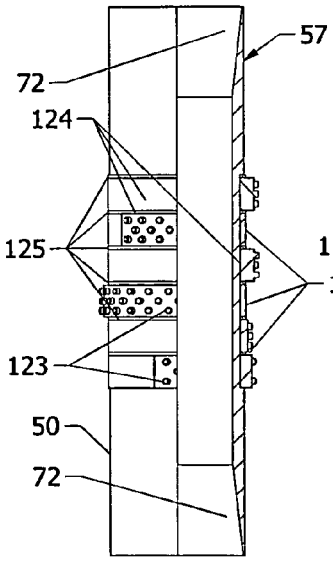
Fig. 9
Section A-A
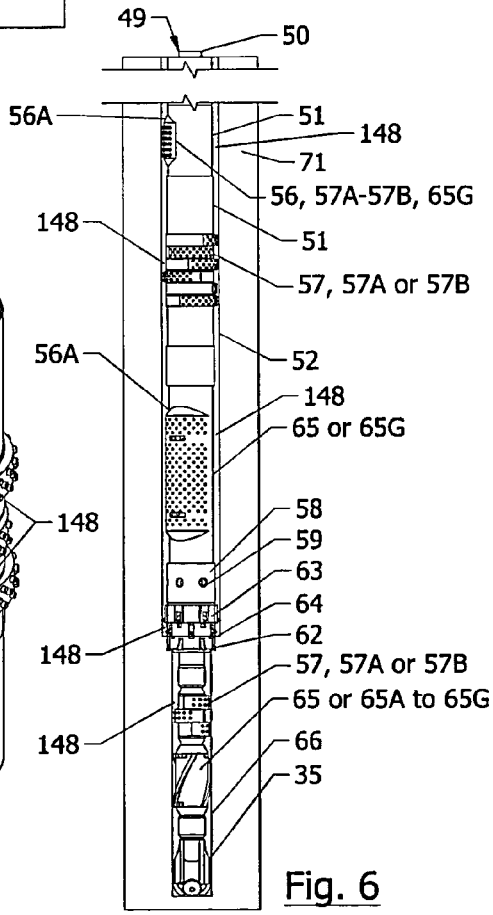
Fig. 6

111A
148
B
57A
50
B 72
50
111A
57
57A
154
124A
125A
123A
148
150
111A
155
50
72

72
57A
57
53
154
111B
C
124A
125A
D
155

Section B-B
53
154
111A
124A
149
125A
123A
148
124A
124A
125A
50A

Detail C
53A
50A
124A
125A
148
153
151
150
155
152
53

Detail D

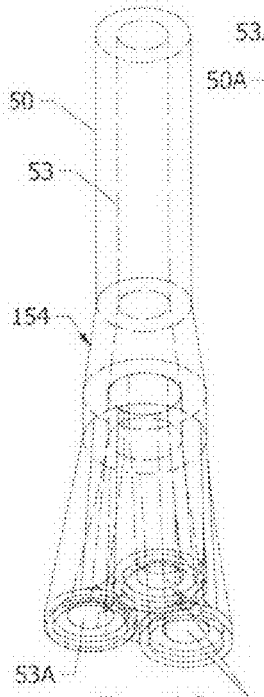
Fig. 16
Fig. 18
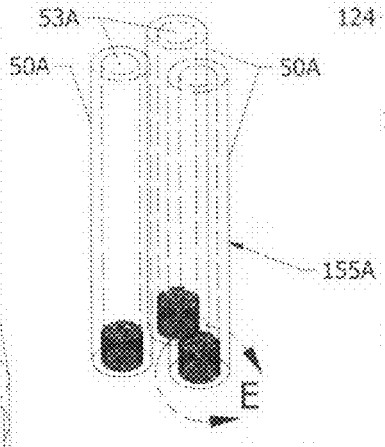
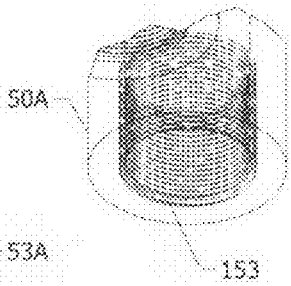
Fig. 19
Detail E
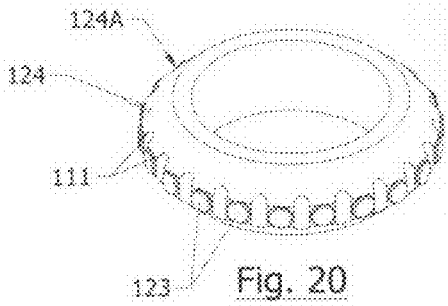
Fig. 20
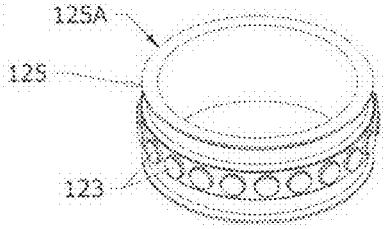
Fig. 21
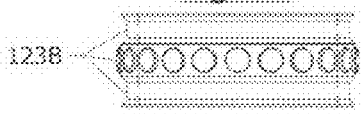
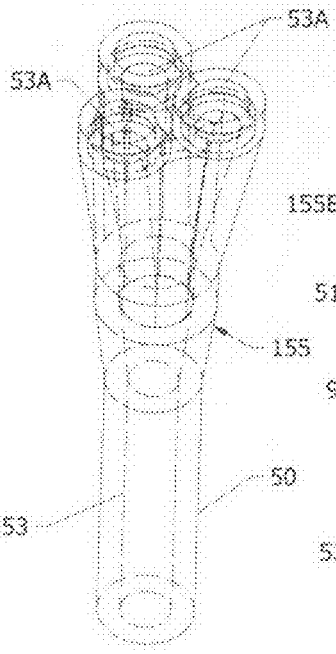
Fig.17
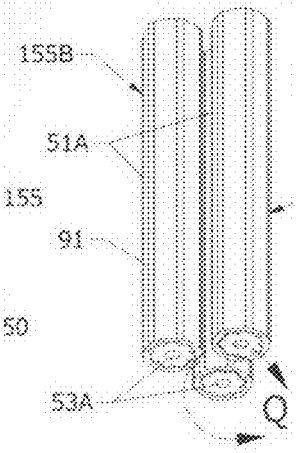
Fig.22A
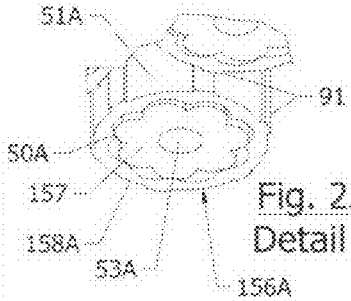
Fig. 22B
Detail Q
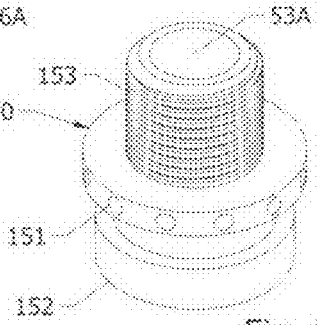
Fig. 22

148
111B
F
55
52
F
148
57B
57
158
156B
157
53
156B
158
154
159
154
111B
123A
148
53A
50
155
53
50
72

Section F-F
157
53
156B
159
57B
57
50
G
111B
155
72

111
51B
123
124C
124
91

123
124
124C
111
91
51B 123
111
51B 124C
51B
124
53
124C
51B
154
53A
148
50A
125
125B
124B
91
51A
148
148
124B
53A
111B
53

Detail G 160A
65A
55
52
H
H
65
148
111
J

Detail J
156
157
158
156C
123
55
111
52
148

51A
111
160

159
111
160A
123
123
111

160B
111
148
51A
50
156C
53
52
55
157
158
52
55
157
158
148
159
65A
65
148
123
53
159
53
148
148
111
148
52
55
111
53
50
72
51A
50
72

Section H-H

111

160C 160D
111
51B
51A
160E
111

Fig. 40
Prior Art
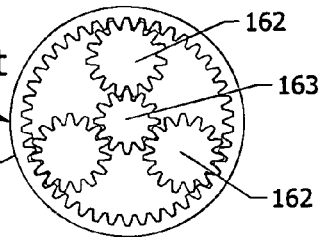
Fig. 41
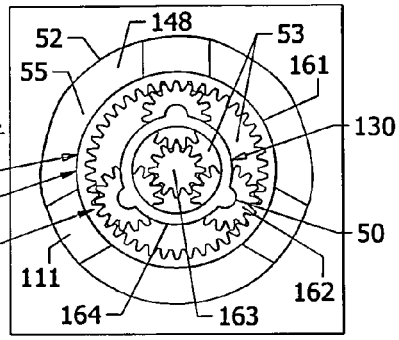
Fig. 42
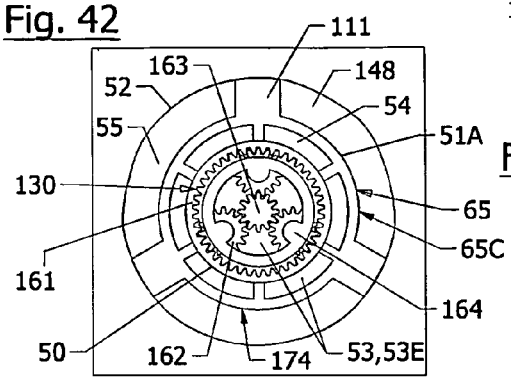
Fig. 43
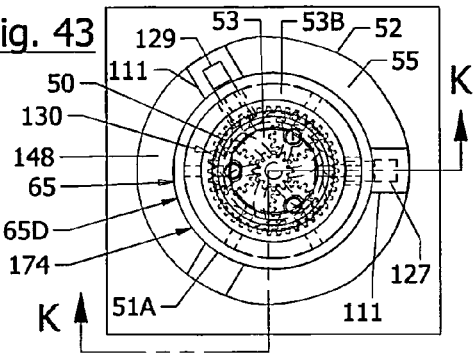
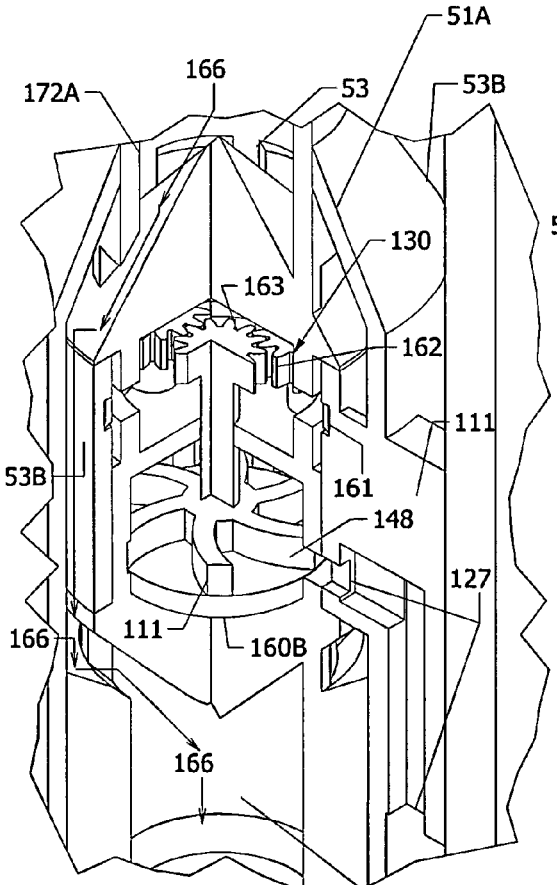
Fig. 45 Detail L
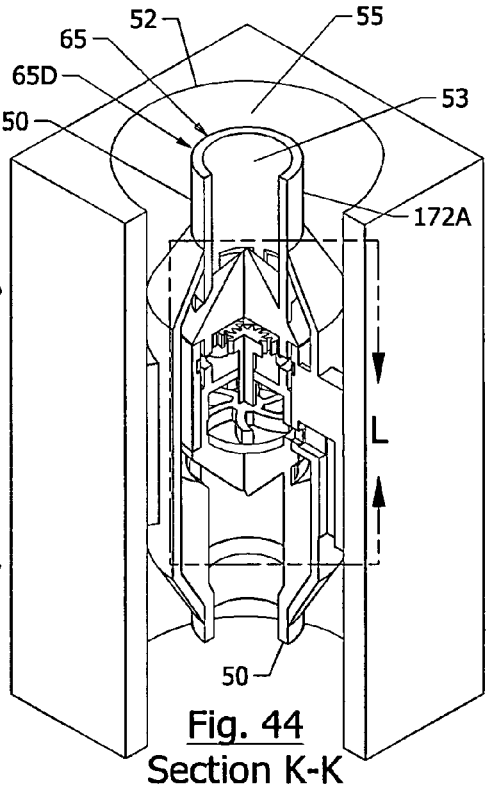
Fig. 44
Section K-K 111
172
51A
M
M
53
65E
65
53
51A
65E
111
172
167
129
148
53C
127
129
N
127
53C
130
172D Section M-M
168
125
161
129
148
53C
127
161
168
51A Section M-M
50
53
167
130
174
168
168
111
148
168
53X
50

172
167
168
162
169
163
170
168
162
169A
171
163
168
160D
172D
111
163
171
169A
162
170
173
148
169
162
53C
174
111

130
129
178
111
127
130
178

Detail N

Section P-P

Section P-P

METHODS FOR USING OR REMOVING UNUSED ROCK DEBRIS FROM A PASSAGEWAY THROUGH SUBTERRANEAN STRATA USING ROCK BREAKING APPARATUS

The present application is a continuation-in-part application that claims priority to U.S. patent application Ser. No. 12/653,784, entitled "Systems And Methods For Using A Passageway Through Subterranean Strata," filed on Dec. 18, 2009, now U.S. Pat. No. 8,387,693 the United Kingdom patent application having Patent Application Number GB0921954.4, entitled "Systems And Methods For Using A Passageway Through Subterranean Strata," filed Dec. 16, 2009, and the United Kingdom patent application having Patent Application Number GB 1021305.6, entitled "Methods For Using Or Removing Unused Rock Debris From A Passageway Through Subterranean Strata Using Rock Breaking Apparatus," filed Dec. 16, 2010, all of which are incorporated herein in their entirety by reference.

FIELD

The present invention relates, generally, to rock breaking apparatus and methods usable to increase the volume of reduced particle size of rock debris, for coating the lower end of a passageway through subterranean strata, and to increase the removal rate for unused rock debris from the upper end of the passageway.

BACKGROUND

Conventional practice involves removing rock debris created when boring a passageway through the subterranean strata without further reducing, albeit incidental reductions of the size of rock debris particles generated by a boring bit. Various boring bits, such as a polycrystalline diamond compact (PDC) bit, may produce a relatively high penetration rate by cutting larger particle size rock from the strata.

The time taken to conventionally bore a passageway is, generally, a balance between the rate of boring and the ability to maintain the pressure, suspension and velocity requirements placed on the circulating fluid slurry system and surface handling equipment used to remove rock debris from the subterranean passageway.

An aspect of the present invention includes increasing the removal rate of unused rock debris from a subterranean passageway by selectively placing rock breaking tools within a conduit string, that can be used to circulate fluid slurry, which can coat the bored strata wall and can remove the reduced particle size rock debris from the subterranean passageway.

The ability of the circulated fluid slurry to urge rock debris from the upper end of the passageway through subterranean strata, where it is processed by surface equipment, is, generally, dependent upon the ability to prevent significant losses of the circulated fluid slurry accompanied by associated losses of circulating pressure and velocity to subterranean fractures encountered or resulting from the rock boring process. The pressure integrity of the wall of the passageway through the subterranean passageway affects the ability of the fluid slurring circulating system to place pressure against the strata wall to increase velocity and to urge larger size rock debris from the upper end of the passageway.

Urging larger rock debris upward with circulated fluid slurry requires more pressure, velocity and fluid slurry suspension property, than urging smaller rock debris upward, because gravity and surface area have a greater effect on the larger particles. Larger particles often slip from the higher velocity centrally disposed fluid slurry stream, within an annular space, to the lower to zero velocity fluid slurry stream, immediately adjacent to an annular passageway walls, where rock debris may fall downward into cutting beds or re-enter the higher velocity fluid slurry stream for forming a slip stream pattern. It is very common to observe rounded edges at the surface when larger particles continually exit and re-enter the fluid slurry slip stream during the removal process.

Periodically, during boring and other well related operations, circulation can be stopped and the gel strength of the fluid slurry may be insufficient to keep larger rock debris particles suspended, resulting in larger particles falling downwards to form cuttings beds.

Reducing the particle size of rock debris increases the rate at which rock debris can be removed by reducing the slippage, relative to larger particles caught in slip stream patterns, or by forming cuttings beds when the fluid slurry has insufficient gel strength.

In deviated bore holes, the effect of gravity on rock debris often causes bored cutting beds to form on the lower side of the annular passageway, preventing the removal of rock debris over a large portion of the annulus. Additionally, if the gel strength of the fluid slurry is insufficient to suspend larger rock debris particles, they can fall downward and rest on inclined cuttings beds that may later shift downwards to trap drill strings.

Large rock debris falling downward and/or inventories or cuttings beds on the lower side of the annular passageway can represent serious risks to boring and other well operations within the passageway through subterranean strata. For example, conduit strings can become trapped or stuck within the bore hole by the accumulation of rock debris around the conduits.

An aspect of the present invention includes creating engagement and rock breaking apertures, that can be used to create a tortuous pathway within a fluid slurry circulated passageway to capture and break larger rock debris particles, while allowing smaller particles to pass. These apertures can be opened, closed, rotated and/or moved to increase the propensity to break larger rock debris more frequently, generating smaller, particle size rock debris sooner so that it can be more readily used or removed.

If the bored strata is prone to fracture, larger rock debris particles can act as proppants within a strata fracture, allowing pressure from the circulating system to reach the point of fracture propagation and potentially aggravating fluid slurry losses to the subterranean strata.

An aspect of the present invention includes reducing the particle size of rock debris, at the lower end of the subterranean passageway, so that the debris is less likely to act as a proppant within a strata fracture and can be more readily used as lost circulation material (LCM) to coat the strata wall and inhibit the initiation or propagation of fractures, which can threaten the pressure integrity of the strata wall and/or reduce the pressure and velocity available to urge unused rock debris from the upper end of the passageway through subterranean strata.

In another aspect, the present invention, can provide improved rock breaking characteristics of member embodiments selectively placed within a conduit string or a rock breaking tool deployed in a subterranean bore hole. This can be achieved by adapting members of the rock breaking tools to form apertures by, for example, open tooling passageway walls so that the rock debris can be impelled against the wall of the passageway through subterranean strata, thereby breaking rock debris and polishing the strata wall at the same time. Alternatively, adapted members using conduit gearing arrangements and/or fluid motors, with differing rotational speeds, can create opening and closing rock breaking apertures.

Another aspect of the present invention can involve additional internal passageways, that can be usable with any rock breaking tool, to drive radial disposed motors or to provide an axial rock crushing aperture with improved access to rock debris, through axial placement within a rock breaking tool.

Finally, another aspect of the present invention can include increasing the volume of reduced particle size debris, at the lower end of a bored passageway through subterranean strata. For example, immediately behind a boring bit generating rock debris, the volume of reduced particle size debris can be increased for immediate use or significantly improved removal, through the addition of adapted rock breaking tool members having higher torque and/or higher speeds using gearing and/or motor arrangements.

A need exists for reducing the particle size of rock debris at the lower end of the passageway through the subterranean strata to increase the immediately usable inventory of rock debris for inhibiting the initiation or propagation of strata fractures potentially threatening the pressure integrity of the fluid slurry circulating system.

A need exists to maintain the circulating system pressure integrity to ensure sufficient velocities are available for the efficient removal of rock debris from a passageway bore through subterranean strata.

A need exists for increasing the effective boring rate of penetration by improving the removal of rock debris from a strata borehole.

A need exists to reduce the risk of becoming stuck by falling rock debris and/or cutting beds on the lower side of an annular passageway.

Various aspects of the present invention address these needs.

SUMMARY

The present invention relates, generally, to rock breaking apparatus and methods usable to increase the volume of reduced particle size of rock debris, for coating the lower end of a passageway through subterranean strata, and increasing the removal rate, from the upper end of the passageway, for unused rock debris by increasing the frequency of rock debris impact and breakage by rock breaking tools, per rotation of the deployment conduit string and/or volume of fluid slurry pumped. Reducing rock debris to LCM sized particles, to inhibit the initiation or propagation of strata fractures, improves the pressure integrity of the strata passageway with the increased volume of reduced particle size rock debris, which reduces the fluid slurry suspension and velocity requirements to urge rock debris that is generated when boring from the subterranean strata passageway.

Conventional practice is to circulate a fluid through a single conduit string or concentric strings, which are formed by a plurality of concentrically disposed conduit strings of smaller diameters within larger diameters, during casing and/or cementing operations. The fluid is circulated axially downward to the lower end of the conduit string(s). The fluid is placed within the passageway bored through the subterranean strata, that contains rock debris from boring, wherein any breakage is incidental, and the fluid slurry must urge all sizes of rock debris axially upward, within one of the passageways between the conduit string(s) and wall of the strata passageway.

Lifting larger rock debris particles can often be problematic, placing significant importance on pumping pressures, pumping velocities, and on the pressure integrity of the strata layers and suspension properties of the fluid slurry used.

Referenced embodiments of the inventions of the present inventor can use one or more rock breaking tools to generate LCM, within the subterranean passageway, from the rock debris inventory coating the walls of said passageway with LCM sized particles to inhibit the initiation or propagation of strata fractures.

Embodiments of the present invention relate, generally, to methods of forming apertures (148, shown in FIGS. 6-12, 14-15, 23, 26, 30-33, 36, 41-43, 45, 48-49, 50, and 53-54), which can be usable to increase the frequency of contact per rock breaking apparatus between adapted members of rock breaking apparatuses and the rock debris inventory within the wall of said passageway, per revolution of the conduit to which the rock breaking tools are engaged and/or per volume of fluid slurry circulated, when, for example, fluid motors are used.

Embodiments of the present invention (FIGS. 6 to 39 and FIGS. 41 to 56) relate, generally, to forming opening, closing and/or moving apertures (148) that can engage the rock debris inventory, within the well bore, to increase the volume of reduced particle size rock debris as a result of increased frequency of contact between adapted member embodiments, that are deployed within any rock breaking tools (56, 57, 63, 65) which can be carried by conduit strings (50, 51) placed within the lower end of the subterranean passageway.

Increasing the frequency of breakage and coating the passageway walls with the resulting reduced particle size rock debris, immediately usable within the unlined lower end of the passageway through subterranean strata as LCM that inhibits strata fracture initiation or propagation, increases the pressure integrity of the unlined portion of the passageway which makes more pressure and fluid slurry velocity available for urging rock debris out of the passageway.

An increased volume of reduced particle size rock debris can increase the volume of usable LCM sized particles, at the lower end of the passageway, for coating the strata wall. In addition, the increased volume of reduced particle size rock debris can increase the rate that the unused rock debris can be removed from the upper end of the passageway, by both improving the pressure integrity of the well bore and reducing the suspension and velocity requirements of the fluid slurry, used to urge unused rock debris from the bore hole.

Various embodiments of the present invention relate, generally, to the urging of rock debris within a subterranean passageway with an open-faced slurrification pump disposed across the annular passageway, with an impellor usable to aid flow of fluid slurry and associated rock debris after it leaves the boring bit.

Increasing volumes of rock debris inventory, that has been reduced to LCM sized particles, makes it more readily available for use and more easily urged to regions of further use or removal, that through reduced size or pumping operations, can increase the rate at which the rock debris inventory, generated by boring the passageway through the strata, can be removed.

Accordingly, preferred embodiments of the present invention provide apparatuses for using and/or removing the rock debris inventory from a passageway bored through subterranean strata.

In preferred rock breaking embodiments (57 of FIGS. 5-6, 11-15 and 23-26; 57A of FIGS. 5-6, 11 to 15; 57B of FIGS. 5-6, 23 to 26; 65 of FIGS. 5-6, 30-33, 41, 42, 43-45, 46-48, 52-54 and 56; 65A of FIGS. 5-6, 30 to 33; 65B of FIGS. 5-6 and 41; 65C of FIGS. 5-6 and 42; 65D of FIGS. 5-6, 43 to 45; 65E of FIGS. 5-6 and 46-48; 65F of FIGS. 5-6 and 52 to 54; and 65G of FIGS. 5-6 and 56), adapted members can be used to increase rock debris particle size reductions, which are generated downhole and can be used for coating the lower end of a passageway through subterranean strata and increasing removal of unused particles urged more easily from the upper end of said passageway, by improving pressure integrity through the inhibition of fracture initiation or propagation and reducing velocity and suspension requirements of the fluid slurry needed to urge rock debris from the passageway.

In preferred rock breaking aperture embodiments (148 of FIGS. 6, 7, 8-9, 10, 11-12, 14-15, 23, 26, 30-33, 36, 41-43, 45, 48-49, 50 and 53-54), the apertures can rotate, open, and/or close to engage and break and/or impel rock debris against surfaces of rock breaking embodiments, other member embodiments, and/or the wall of the passageway through subterranean strata to further increase the volume of reduced particle size rock debris.

In various other preferred member embodiments comprising: milling bushing members (124A of FIGS. 11-15 and 20; 124B of FIGS. 23-26 and 124C of FIGS. 27-29) and, thrust bearing members (125 of FIGS. 23-26 and 125A of FIGS. 11-15 and 21) and blades (111), the members and/or blades can be adapted and arranged to create an aperture member embodiment for capturing, hurling, and/or breaking the rock debris, against impact surfaces of rock breaking tools or the wall of the passageway through subterranean strata, for use to inhibit the initiation or propagation of strata fractures or to make the removal of unused rock debris more effective.

In related preferred embodiments, free wheeling milling bushing members (124A of FIGS. 11-15 and 20) and thrust bearing members (125A of FIGS. 11-15 and 21) are adapted for eccentric placement, about the conveying conduit string, creating bushing milling and/or thrust bearing stacks that form adapted blades (111A of FIGS. 11-15, 111B of FIGS. 23-26), that rotate when the connected conduit (50) rotary connections (72) are turned.

In alternative preferred embodiments, single-unit members with offsetting profiles (123A of FIGS. 11 and 24, 123B of FIG. 21) or stacks of free-wheeling, milling bushing members (124A of FIGS. 11-15 and 20; 124B of FIGS. 23-26 and 124C of FIGS. 27-29); thrust bearing members (125A of FIGS. 11-15 and 21); eccentric, rotating blade members (111A of FIGS. 11-15 and 111B of FIGS. 23-26); and/or blades (111) can be used to construct an aperture (148) for the engagement and rock debris particle size reduction between the rock breaking tools, the members and/or the wall of the passageway through subterranean strata.

In other various preferred embodiments, one or more motor members (156A of FIGS. 22A-22B, 156B of FIGS. 23-26 and 156C of FIGS. 30 to 33) can comprise a positive displacement fluid motor, depicted herein, or, for example, a high speed fluid turbine or any other motor that can be suitable for downhole deployment and usable to increase the rotational speed of rock breaking tool members to further increase the volume of reduced particle size rock debris, for use within or removal from bored subterranean passageway.

Alternate preferred embodiments can use motors with rotating internal components (156B of FIGS. 23-26, 156C of FIGS. 30-33), relative to a housing fixed to the conveying conduit, and/or a rotating housing with internal components (156A of FIGS. 22A-22B) fixed to the conveying conduit. The motor members (156B, 156C) can be aligned axially with the conduit string (50,51) used to carry the rock breaking tool and/or can be radially disposed motor members (156A, 156B with 156A used on blade members 111B) that rotate about, and/or eccentrically to, the axis of the conveying string.

In various other preferred embodiments, the internal passageway (53) and/or additional annular passageways (54), carrying circulated fluid slurry within a conduit string, can be diverted through additional passageways (53A of FIGS. 14-15, 16-18, 22, 22A-22B and 24-26, 53B of FIGS. 43-45, 53C of FIGS. 47-48, 53D of FIGS. 52-54) to provide axial space for rock breaking apparatus (123, 123A, 124, 125A, 111, 111A, 111B), apertures (148), motor (156A) and/or slurry pumping (160A of FIG. 34) members.

Still other preferred embodiments use gearing member assemblies (130 of FIGS. 41-45, 47-48, 50-56) to increase the relative rotational speed between at least one impact surface (123, 123A, 123B), blade (111, 111A, 111B), eccentric blade (56A), milling bushing (124, 124A, 124B, 124C), drive bearing (125, 125A), or rock breaking aperture (148) and rock debris, other rock breaking tools and/or the passageway through subterranean strata to increase the volume of reduced particle size rock debris used within or removed from the subterranean passageway, per revolution of the conveying conduit string and/or per volume of fluid slurry circulated when one or more fluid motor member and gearing member are combined.

In related preferred embodiments (167 of FIG. 51), the gearing assembly can first increase/decrease and, then, decrease/increase, respectively, the relative rotational speed of the rock breaking member (56A, 111, 111A, 111B, 123, 123A, 123B, 124, 124A, 124B, 124C, 125, 125A, 148), the conveying conduit string (50, 51), the motor members and/or other gearing members for meeting the torque and rotational speeds of boring through strata, while increasing the frequency of impacting, impelling and/or breaking rock debris.

Adapted rock breaking members (56A, 111, 111A, 111B, 123, 123A, 123B, 124, 124A, 124B, 124C, 125, 125A, 130, 148) can be usable with any rock breaking tool (56, 57, 57A-57B, 63, 65 and 65A-65G), that is disposed about at least one conduit string (50, 51) to, in use, increase the volume of reduced particle size rock debris, that is used downhole to inhibit the initiation or propagation of strata fractures, or reduced particle size rock debris that is removed from the bored strata passageway of improved pressure integrity, having lower suspension and velocity requirements placed on the fluid slurry that conveys the rock debris within and from the passageway through subterranean strata.

BRIEF DESCRIPTION OF THE DRAWINGS

Preferred embodiments of the invention are described below by way of example only, with reference to the accompanying drawings, in which:

FIG. 5 illustrates a prior art depiction of boring a passageway through subterranean strata.

FIGS. 6 to 10 depict rock breaking tools, wherein adapted member parts can be added to increase a frequency for breaking rock debris, used within or removed from the bore hole.

FIGS. 16 to 22 show members of the rock breaking tool of FIGS. 11 to 15.

FIGS. 22A to 22B depict adapted fluid motor members usable to replace the member of FIG. 18, wherein a plurality of motors can be used in the rock breaking tools of FIGS. 11 to 15 and FIGS. 23-26.

FIGS. 30 to 33 illustrate a rock breaking apparatus embodiment disposed within a subterranean passageway and driven by a motor member showing rotational stabilizer blades, disposed about an impellor that is open to the strata passageway and rock debris beds.

FIGS. 34 and 35 depict the impellor member and rotational stabilizing blade member embodiments, respectively, of FIGS. 30 to 33, usable for pumping slurry within a bore hole after the slurry has left the boring bit.

FIGS. 36 and 37 depict an embodiment of an impellor member disposed within a rotational stabilizing blade member, wherein FIG. 37 shows only the rotational stabilizing blade member of FIG. 36.

FIGS. 38 and 39 illustrate various rock breaking tool impellor member embodiments usable to impact and/or impel rock debris.

FIG. 40 depicts a prior art planetary gearing arrangement.

FIGS. 41 and 42 show plan views of an embodiment of a rock slurrification apparatus with planetary gearing members disposed within a passageway through subterranean strata.

FIGS. 43 to 45 illustrate a rock slurrification embodiment using a planetary gearing member and impellor disposed within the strata passageway.

Embodiments of the present invention are described below with reference to the above listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

The present invention relates, generally, to methods for using rock debris, or removing unused rock debris, from a bored passageway through subterranean strata using at least one rock breaking apparatus and providing a fluid slurry, communicated toward the lower end of at least one conduit string that can be placed within a proximal region of an unlined portion of said passageway through subterranean strata, which contains an inventory of rock debris. The methods continue by circulating the fluid slurry from the proximal region to urge at least a portion of the inventory of rock debris, for use within or removal from said passageway through subterranean strata. The embodiments of the methods include providing at least one rock breaking apparatus, that can be engaged with at least one conduit string, placed in the proximal region with at least one member adapted to increase a volume of reduced particle size rock debris. The volume of reduced particle-size rock debris is generated by increasing the frequency of impact and associated breakage of the inventory of rock debris, within the proximal region, per revolution of the at least one conduit string, and per volume of the fluid slurry circulated, or combinations thereof. The used volume of rock debris can coat an unlined strata wall of the passageway to inhibit strata fracture initiation or propagation. The unused volume of rock debris can be urged from the upper end of the passageway, at an increased rate by an associated reduction in fluid slurry suspension or velocities, to urge the reduced particle size rock debris from the passageway through the unlined portion, having improved pressure integrity from inhibiting the initiation or propagation of strata fractures.

Figure 1:
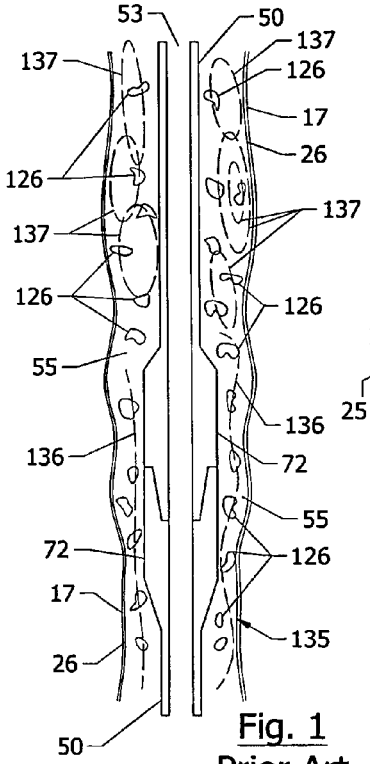
Fig. 1 Prior Art
FIGS. 1 to 4 depict prior art diagrams of rock debris inventories and fluid slurry flow characteristics during rock debris removal from a passageway through subterranean strata containing a conduit string and/or changes in the size of the annular passageway.

Referring now to FIG. 1, an elevation cross-section view of a slice through a subterranean strata bore hole is depicted and shows the generally accepted prior art concept (135) of urging rock debris (126), within a higher velocity fluid stream (136) at the center of a first annular passageway (55), axially upward within a subterranean passageway (52, shown in FIG. 8), that contains a conduit string (50) having an internal passageway (53) for circulating fluid slurry axially downward and rotary connections (72), that affect velocities within the first annular passageway by reducing its cross-sectional area.

Smaller rock debris, with lower mass and surface area, are better urged upward and can suspend within fluid slurry better than larger rock debris (126), with more surface area and mass, potentially causing them to be pushed away from the highest velocity annular stream (136) and toward the containing walls, including the strata walls (17), which can contain the filter cake (26), and the walls of the conduit string (50), disposed approximately equidistant from said where frictional forces cause the fluid slurry circulating velocity to approach zero. Gravitational effects on larger masses can cause such masses to fall axially downward through the fluid slurry, if the suspension properties or gel strength of the fluid slurry is insufficient to suspend the larger masses of rock debris.

Higher velocities through restricted cross-sectional areas of the first annular passageway (55) created by diameter reductions, such as a rotary connection (72), help urge larger rock debris particles axially upwards until the first annular passageway enlarges enough for slip streams (137) to form. The larger rock debris particles can separate from the faster fluid slurry stream (136) due to the variations of velocities across their surface area and the irregular shape and disposition of their mass.

Figure 2:
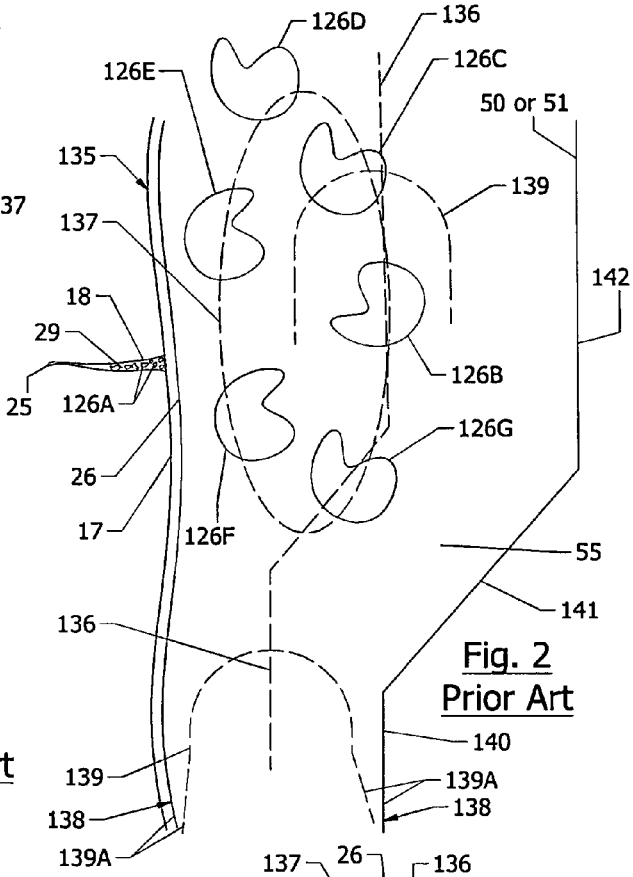
Fig. 2 Prior Art

FIG. 2, an elevation cross section partial view of a slice through a subterranean bore hole along the axis of the bore hole, shows one half of the first annular passageway (55) between containing walls (17, 50, 51, 140, 141, 142). FIG. 2 illustrates a magnified view of the generally accepted prior art concept (135) of urging rock debris (126) through an annular space in the manner described in FIG. 1.

Faster fluid slurry velocity within a centrally disposed stream (136) travels between the strata wall (17), coated with a filter cake (26), and a conduit string (50 or 51 described in FIG. 6), having a larger outside diameter (140) that transitions (141) to a smaller outside diameter (142), causing the central fluid slurry stream (136) within the annular passageway (55) to slow and seek the path of least resistance, approximately equidistant from the friction of the containing walls (17, 50 or 51 described in FIGS. 6, 140, 141 and 142).

The velocity of the fluid slurry moving axially upward increases (139A) from zero, immediately adjacent (138) to the containing walls (17, 50 or 51, 140, 141 and 142), to its highest level at the path of least resistance forming an elliptical shaped stream (139) that can be approximately equidistant from the containing walls, dependent on frictional factors of the containing walls and a laminar flow state.

High velocities and frictional factors within the annular passageway may cause turbulent flow to remove the laminar central flow stream (136) and associated slip streams (137) from the first annular passageway (55). However, higher velocities require higher pumping rates and associated pressures that can cause fractures (18), within the strata, to reduce the pressure integrity of the strata wall (17), taking pressure from the circulating system and reducing associated velocity needed to maintain a turbulent flow.

Larger rock debris particles (126), urged axially upward by the fluid slurry, can be carried through the higher velocity elliptical stream or turbulent flow within the first annular passageway (55), between the strata wall (17) and the conduit string's largest diameter (140), until reaching a lower velocity portion of the first annular passageway, between the strata wall (17) and the smaller diameter (142) of the conduit string (50 or 51) and/or fractured strata (18), that may reduce pressures and associated velocities until the forces propelling the rock debris are insufficient to urge it axially upward effectively.

Fractures (18) existing within the strata wall (17), that are not sealed by the filter cake (26), allow circulating pressures to reach the point of fracture propagation (25), potentially further propagating the fracture and reducing pressures and associated velocities within the first annular passageway and further making the urging of larger particle size rock debris less efficient.

Embodiments of the present invention reduce the particle size of rock debris (126A) to sand size particles, generally recognized to be LCM in the range of 250 to 600 microns, that can choke (29) a fracture (18) to allow the filter cake (26) to bridge the fracture and differentially pressure seal the point of fracture propagation (25) from the circulating fluid slurry pressure, thus inhibiting the initiation or propagation of such strata fractures.

For laminar flow situations, a larger particle (126B) within the central fluid slurry stream (136) may have one portion of its surface area subjected to the differing velocities (126C) of the elliptical stream (139) causing it to move into a slip stream (137 and 126D), where the velocity is insufficient to suspend the particle, and causing it to fall (126E and 126F) until it re-enters the central stream (126G) and travels axially upward again, or comes to rest in a cuttings bed.

Figure 3:
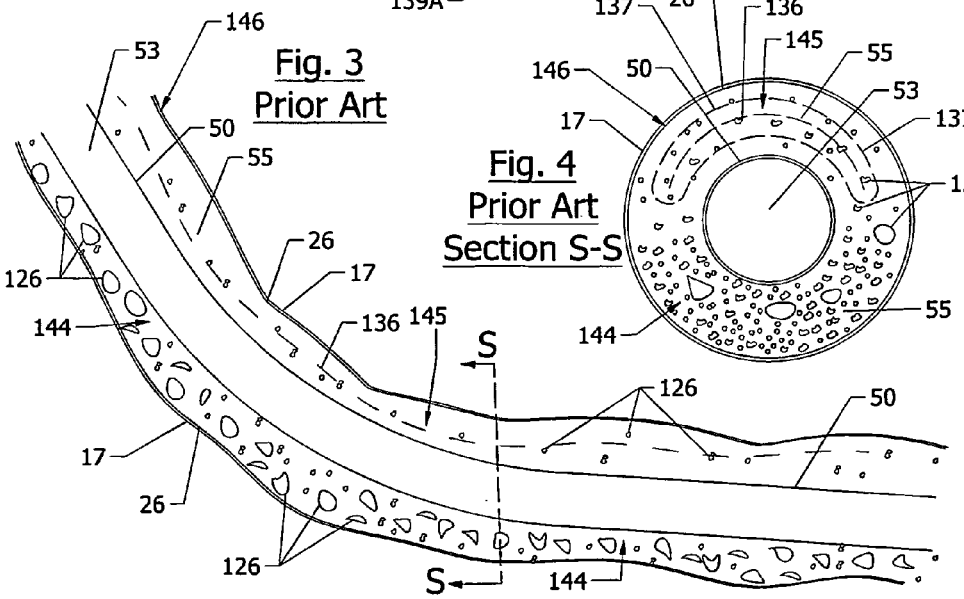
Fig. 3 Prior Art
Figure 4:
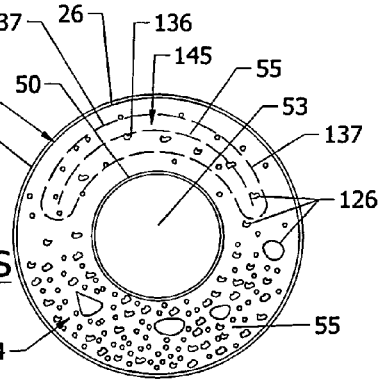
Fig. 4 Prior Art

Referring now to FIG. 3, an elevation cross section view along the axis of a deviated bore hole sliced through the subterranean strata, with section line S-S associated with FIG. 4, is depicted. The Figure shows the generally accepted prior art concept (146) of cuttings beds, where gravity causes the rock debris (126) to fall and come to a relatively stationary position or roll on the lower side (144) of the bore hole (17), where circulation can be greatly reduced, fluid slurry can be forced to travel and rock debris can be urged within the upper side (145) of the passageway, wherein a laminar flow central flow stream (136) can form dependent on a number of factors, including the speed of conduit (50) rotation, fluid slurry velocity and frictional forces within the passageway.

FIG. 4 depicts an elevation cross section view along line S-S of FIG. 3 and perpendicular to the axis of a bore hole (17) through the subterranean strata, showing the conduit string (50) having an internal passageway (53) through which fluid slurry is pumped. The Figure shows a first annular passageway (55) through which slurry returns in the upper portion (145), and wherein the lower side (144) can be choked by a cutting bed or inventory of rock debris (126).

In laminar flow fluid slurry situations, a centralized flow stream (136), having higher velocity fluid slurry, seeks the path of least resistance around which an elliptic or conical pattern will exist, that affects larger rock debris particles differently than smaller ones.

Common practice for reducing the impact of cuttings beds or a build-up of rock inventory on the lower side (144) of the bore hole (17) is to pump, at elevated rates, and rotate the conduit (50) sufficiently to stir cutting inventories and create turbulent flow of the fluid slurry within the passageway through subterranean strata, thus eliminating the flow streams (136, 137) at the upper side (145).

Creating continuous turbulent flow is however difficult because rotation must be stopped intermittently, for example, to make a conduit connection when running into or pulling out of the hole, and larger rock debris particles are harder to suspend, especially with the short distances required to form a cuttings bed. Additionally, high rotational rates, intended to impact the sides of the bore to stir cuttings beds with higher pumping rate pressures, can mechanically and hydraulically initiate and propagate fractures within the strata wall (17), when insufficient LCM material is available to perform well bore strengthening.

Rock debris removal efficiency of the fluid slurry can be improved by increasing the volume of reduced particle size rock debris and, consequently, forms LCM that can be immediately used, especially during periods of high pipe rotational speeds accompanied by higher pumping pressures to inhibit the imitation or propagation of strata fractures (18 of FIG. 2).

Embodiments of the present invention are usable to increase the volume of reduced particle size rock debris more easily suspended by a fluid slurry. This prevents the build up of cuttings beds when insufficient conduit rotation or fluid slurry velocity is present. Embodiments of the present invention can reduce the propensity of rock debris to follow a slip stream (137).

The fluid slurry can become more viscous as a result of the increased volume of reduced particle sizes suspended in the fluid slurry. The suspension properties of the fluid in turbulent flow or laminar flow are thereby increased, improving fluid slurry urging efficiency and increasing the rate that unused rock debris is removed from the passageway through subterranean strata (52).

Referring now to FIG. 5, an elevation cross section view of a slice through subterranean strata showing the boring of a hole, with prior art drilling (33) and prior art casing drilling (40) apparatuses, is depicted. The Figure shows a derrick (31) used to hoist a single walled drill string (33, 40), bottom hole assembly (34, 42 to 48), and boring bit (35, shown in FIG. 6) through a rotary table (32) to bore through strata (30). Prevalent prior art methods use single walled string apparatus to bore a hole and place linings to form a passageway through subterranean strata, that can use various embodiments of rock breaking tools (57, 57A-57B, 65, 65A-65G) and inventions of the present inventor for single or dual walled strings.

FIGS. 6 through 10 depict tools for managed pressure and single walled conduit strings using rock slurrification tools and milling bushing tools of the present inventor, usable or replaceable with various embodiments of the present invention.

Embodiments of the present invention and referenced inventions of the present inventor are usable with the claimed methods of the present invention to engage cutting beds or rock debris on the lower side (144 of FIGS. 3 and 4) of a passageway or to create tortuous pathways and apertures (148) with reduced cross section, like those described in FIGS. 1 to 4, and wherein smaller rock debris is more effectively urged by the fluid slurry than larger rock debris.

Aperture embodiments (148) of the present invention are usable by rock breaking tools of the present inventor to increase the volume of reduced particle size rock debris for more effective use within, or removal from, the passageway through subterranean, as described in the following embodiments.

Referring now to FIG. 6, an elevation cross section view of a slice through the strata of a borehole, with an unsliced managed pressure or conduit string assembly (49) of the present inventor placed within, is depicted. The Figure includes multiple aperture embodiments (148) of the present invention formed between members of the conduit string assembly (49) and the passageway through subterranean strata (52), wherein rock breaking tools are replaceable by embodiments of the present invention (57, 57A-57B, 65, 65A-65G).

Rock breaking tools (56, 57, 63, 65) usable with a managed pressure conduit assembly (49) and various slurry passageway tools (58) with orifices (59), that use multi-function tools to selectively manage circulating pressure and urge first conduit strings (50) and nested additional conduit strings (51) axially downward while boring the passageway through subterranean strata (52), are usable with or replaced by embodiments of the present invention to increase the volume of reduced particle size rock debris that is usable to decrease slurry velocity and associated effective drilling density within the first annular passageway, between the tools and the strata. Managed pressure strings (49) employing actuation and multi-function tools with rock breaking apparatus can selectively change velocities and pressures applied with slurry passageway tools (58), repeatedly. Actuation tools, such as spear darts used with baskets, can operate multifunction tools, whereby the entire string can be used to manage slurry losses by injecting and compacting LCM, which is created by the rock breaking tools (56, 57, 57A-57B, 61, 63, 65, 65A-65G) to inhibit the initiation or propagation of fractures within subterranean strata and/or to increase the rate of removal of unused rock debris.

Additionally, rock breaking tools (56, 57, 57A-57B, 61, 63, 65, 65A-65G) can be adapted and engaged with large diameters of the dual walled drill string to mechanically polish the bore through subterranean strata, thereby reducing rotational and axial friction. The tools and large diameter of the dual wall string also mechanically apply and compact LCM against the filter caked wall of strata, into strata pore and fracture spaces, to further inhibit the initiation or propagation of fractures within subterranean strata.

Urging the passageway through subterranean strata axially downward can be achieved by using a boring drill bit (35) rotated with the first string (50), the additional outer string (51), and/or a motor to create a pilot hole (66) within a bottom hole assembly. The bottom hole assembly can include a rock breaking tool (65) and/or embodiments of the present invention (65A-65G) for slurrification of rock debris generated from the drill bit (35), internally or through an aperture (148) against the strata walls by use of other various rock breaking tools (56, 57, 57A-57B, 61, 63, 65, 65A-65G), which are placed on the additional outer conduit string (51) to enlarge the hole for its passage and/or smearing and polishing the walls of the passageway through subterranean strata.

FIG. 6 shows an embodiment of rock breaking tools for enlarging the lower portion (64) of the passageway (62) through subterranean strata (52). Blades (111, as shown in FIG. 20) and eccentric blades of the rock breaking tools (56, 57A-57B, 65, 65A-65G) are provided with rock cutting, breaking or crushing structures incorporated into the blades or eccentric blades for impacting or removing rock protrusions from the wall of the passageway through subterranean strata (52) or for impacting rock debris internally and centrifugally. Additionally, when it is not desirable to utilize the rock breaking tool (57A-57B, 65, 65A-65G) to further break or crush rock debris, or should the rock breaking tool (57A-57B, 65, 65A-65G) become inoperable, the rock breaking tool (57A-57B, 65, 65A-65G) can function as a stabilizer along the depicted strings.

Referring now to FIG. 7, a plan cross sectional view perpendicular to a bored passageway through subterranean strata with dashed lines showing hidden surfaces is depicted. The Figure shows a slurrification tool (65) having an eccentric blade (56A) forming an aperture (148) member embodiment, that can vary elliptically relative to a central axis of the conduit string and usable to form alternative embodiments of the present invention.

The Figure depicts slurry being pumped axially downward through the internal passageway (53) and returned through the first annular passageway (55), between the rock slurrification tool (65) and the passageway through subterranean strata (52). The rock slurrification tool (65) acts as a centrifugal pump taking slurry from said first annular passageway (55), through an intake (127), and into an additional annular passageway (54) where an impellor blade (111) impacts and urges the breakage and/or acceleration of dense rock debris particles (126) toward an impact wall (51), having impact surfaces (123) for breaking said accelerated dense rock debris particles (126). Engagements between the impeller blades (111), rock debris particles (126) and impact walls (51) continue until said slurry is expelled through an exit port (129). The impact wall (51) has a spline arrangement (91) for rotating the eccentric bladed wall (56A) and can be removed if the eccentric wall forms part of the protective lining of a dual walled string or managed pressure conduit assembly (49 of FIG. 6), wherein an aperture (148) member can be formed by rotation of the eccentric blade. Alternatively, if the eccentric blade is used to anchor a gearing arrangement, such as those described in FIG. 56, and an adapted intake member (127A) is used, the aperture will capture rock debris when the eccentric blade engages a cuttings bed to feed the slurrification pump.

Various adapted member embodiments of the present invention are usable with slurrification tools (65) of the present inventor. For example, the embodiment of FIGS. 22A and 22B can be used, wherein the additional wall (51B of FIG. 7) is driven by splines (91 of FIGS. 22A and 22B) of a different additional wall (51A of FIGS. 22A and 22B) and driven by the motor (156A of FIG. 22A).

An alternative embodiment results when the additional wall (51A) member (160) of FIGS. 30 to 33 and FIG. 35 is replaced by the eccentric blade (56A), with the internal impellor (160A) driven by the motor arrangement (156C) of FIGS. 30 to 33, and wherein the eccentric blade (56A) creates an aperture (148) with the wall of the passageway through subterranean strata. Alternatively, the impellor (160A of FIG. 34) can be replaced by an eccentric blade (56A) without an intake (127 or 127A), that, when turned by the motor (156C of FIGS. 30-33), creates a rotating aperture that impels rock debris and creates turbulent flow throughout the first annular passageway.

Referring now to bushing milling tools of FIGS. 8 to 10, aperture (148) member embodiments usable with the bushing milling stabilizer embodiments, shown in FIGS. 11 to 15 and FIGS. 23 to 26, are depicted. The Figures show eccentric bushings (124) that can be bushing member embodiments (124A of FIGS. 11 to 15, 124B of FIGS. 23 to 26 and 124C of FIGS. 27 to 29) with thrust bearing embodiments (125 of FIGS. 11 to 15, 21 and 26). Alternatively, the dual string arrangement of FIG. 10 can replace the motor and driven bushing mills of FIGS. 23 to 25 in a dual conduit managed pressure arrangement (49 of FIG. 6).

Referring now to FIG. 8, a plan view of a bushing milling tool (57), disposed within the passageway through subterranean strata (52) with line A-A associated with FIG. 9, is depicted. The Figure shows an aperture (148) member embodiment between the tool and the strata passageway. The free rotating surfaces of the eccentric milling bushings (124, shown in FIGS. 9-10) create a tortuous slurry path within the passageway through subterranean strata (52), such that rock debris in the first annular passage (55 of FIG. 7) is trapped and crushed between said bushing milling tool (57) and the wall of the passageway through subterranean strata (52 of FIG. 7), urging rotation of individual bushings and further urging an increase in the volume of reduce particle size rock debris.

Figures 23, 24, 25, 26, 27, 28, 29:
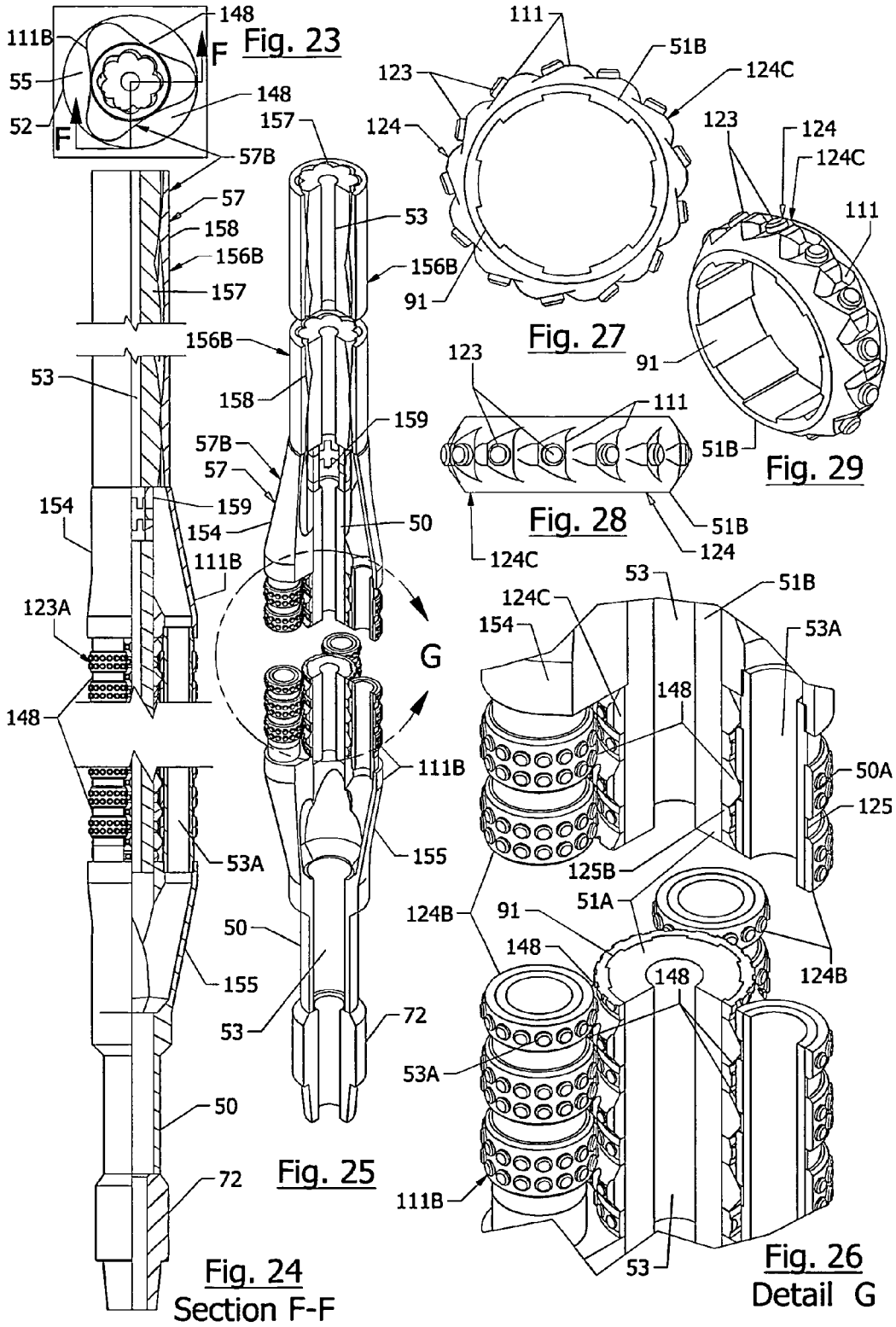
FIGS. 23 to 26 illustrate a rock breaking tool embodiment with free-wheeling bushing mills and thrust bearings that are eccentrically disposed about motor-driven, central, bushing milling and thrust bearing stacks.
FIGS. 27 to 29 show various views of a motor-driven milling bushing member embodiment with impact surfaces.

Alternative embodiments of a bushing milling tools (57A or 57B) of FIGS. 11 to 15 or FIGS. 23 to 26 are formed when eccentric bushing mills (124) are used on one or more stacked bushing blades (111A or 111B of FIGS. 11-15 or FIGS. 23-26, respectively) at a sufficient radius to prevent clashes and to form a centralized aperture embodiment (148 of FIG. 12 and FIG. 23) that opens and closes between bushing stacks, a fixed profile (123A of FIG. 11) or motorized (156B) bushing stacks, or fixed profiles (123A of FIG. 24).

Referring now to FIG. 9, a cross-sectional elevation view of the bushing milling tool of FIG. 8 taken along line A-A of FIG. 8, with the passageway removed is depicted. In the Figure, offsetting bushings mills (124) are shown creating a tortuous slurry path and forming an aperture embodiment for catching and breaking rock debris. Frictional string rotation on rock debris or cuttings beds trapped next to the bushing's non-eccentric surface urges one eccentric surface to rotate relative to another creating a changing aperture member engagement, wherein rock debris can be further trapped by eccentric bushings axially above, and wherein larger rock debris particles are more likely to be caught than smaller particles, that may travel around the bushings tortuous changing aperture pathways with fluid slurry passing the tool. Aperture members (148) are usable with single walled drill strings (33 or 40 of FIG. 5) and managed pressure conduit strings (49 of FIG. 6).

Referring now to FIG. 10, an isometric view of a bushing milling tool (57) is shown depicting similar aperture members (148) to that of FIGS. 8 and 9. The tool (57) includes a plurality of stacked additional rotating walls or bushings having eccentric surfaces (124) engaged with hard impact surfaces (123) and intermediate thrust bearings. The depicted bushing milling tool has eccentric milling bushings (124), disposed about a nested wall of an additional conduit string (51) and the first conduit string (50), for use with a managed pressure conduit assembly (49 of 6).

Referring now to FIGS. 11 to 15 and FIGS. 16 to 22, an embodiment of a bladed (111A) stabilizing bushing mill (57A) and member embodiments (154, 155, 155A, 124A, 125A and 150) of said bladed stabilizing bushing mill, respectively, are shown. The Figures illustrate the splitting of the internal passageway (53) into three additional internal passageways (53A), about which bushing mills (124) and thrust bearings (125) rotate through friction with the strata wall or other bushing mills or thrust bearings to create an aperture (148) member, that engages and breaks rock debris within the subterranean passageway when the conduit string (50) is rotated.

This bladed stabilizing bushing mill is usable to engage cutting beds or rock debris inventories on the lower side (144 of FIGS. 3 and 4) of a passageway or to create a tortuous pathway with reduced cross section (e.g. between 17 and 140 of FIG. 2) that smaller rock debris may pass more effectively than larger rock debris, engaged by its aperture and broken to increase the volume of reduced particle size rock debris for use within or removal from the passageway through subterranean strata.

Figures 11, 12, 13, 14, 15:
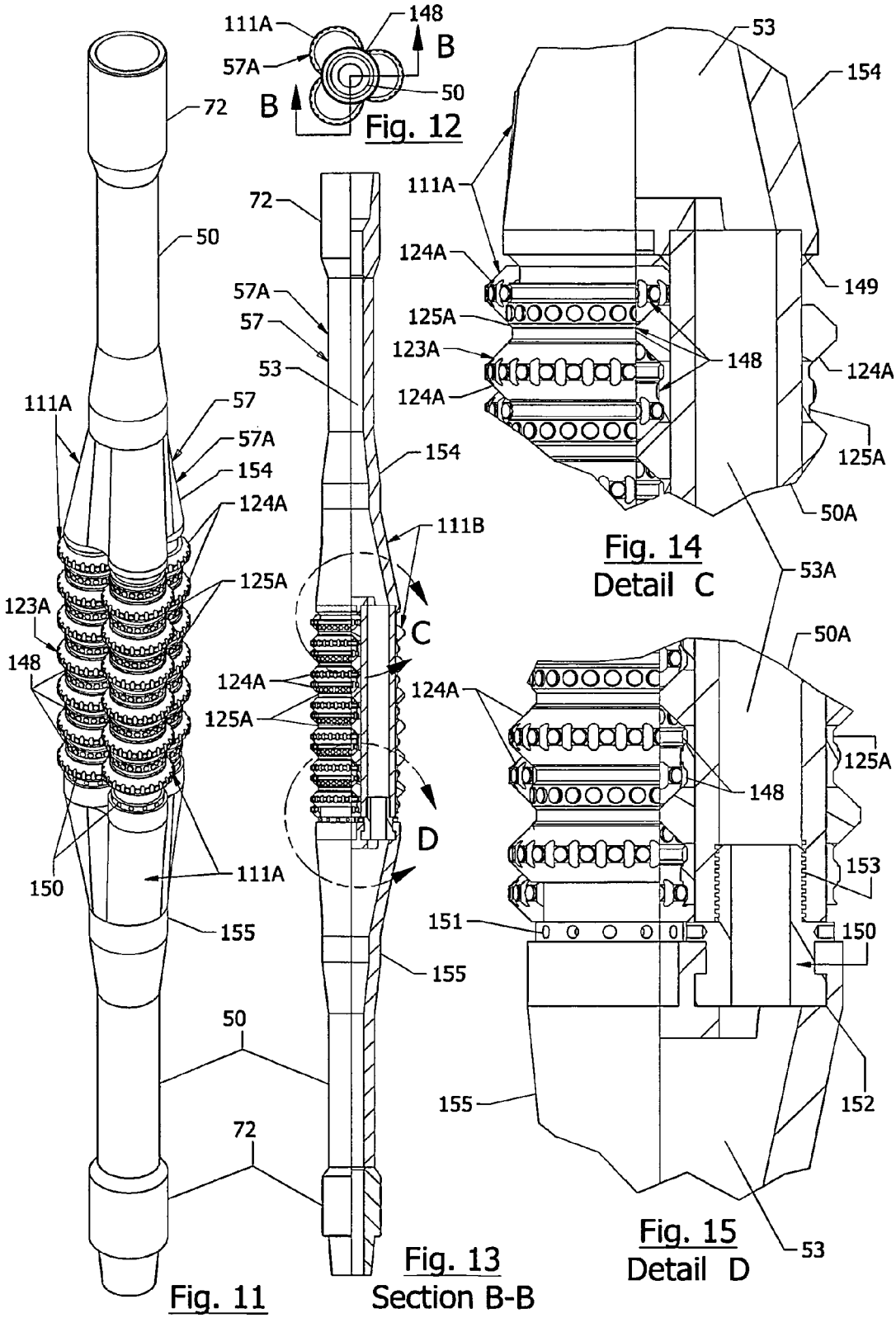
FIGS. 11 to 15 illustrate an embodiment of a rock breaking tool comprising free-wheeling, bushing mills and thrust bearings placed eccentrically about the conveying central conduit string to form blades that function as both rock breaking tools and rotational stabilizers.

Referring now to FIG. 11, an isometric view of an embodiment of a bushing mill (57), adapted to become a bladed bushing mill (57A), is depicted. The Figure shows the formation of a radial blade (111A) arrangement extending radially outward from the conduit string (50), wherein rotating bushing mills (124A of FIGS. 14 and 15) and thrust bearings (125A of FIGS. 14 and 15) from said radial blades and are meshed with other bushing mills and thrust bearings on other radial blades. When the blades and thrust bearings rotate, an aperture (148 of FIGS. 12 and 14-15), for engaging and crushing rock debris, is formed by said meshing of bushing mills and thrust bearings rotated by the rotary connection (72, also shown in FIG. 10) conveying conduit string (50) rotation and friction with the strata wall, other bushing mills, other thrust bearings, and/or friction from rock debris to create a grinding mill within the strata bore hole.

An additional aperture embodiment can be formed between meshing bushing mills on each radial bushing blade (111A), if one or more fixed profiles (123A), conforming to the stack of bushing mill profiles shown, replaces the stack of bushings and thrust bearings to cause rotation along the entire blade instead of individual rotation by each stacked member. In still other alternative embodiments a variation of this aperture can be formed by using a single bushing mill, with a fixed impact profile (123A) coupled with a motor (156A of FIGS. 22A and 22B), on each radial bushing blade (111A) to drive the resulting rock debris grinding mill.

FIG. 12, a plan view of the bladed bushing mill of FIG. 11 with section line B-B associated with FIG. 13, is depicted and shows the aperture (148) created by the meshing of the bushing mills and thrust bearings forming the rotating radial bushing blade (111A) about the conveying conduit string (50).

FIG. 13, an elevation cross sectional view along line B-B of FIG. 12 with detail lines C and D associated with FIGS. 14 and 15 respectively, is shown and depicts the splitting of the internal passageway (53) into additional internal passageways (53A, shown in FIGS. 14 and 15) using an upper exit chamber housing (154) and lower exit chamber housing (155) with intermediate conduits about which the bushing mills (124A) and thrust bearings (125A) rotate.

Referring now to FIG. 14, a magnified detail view of a portion of the bladed bushing mill (57A) within line C of FIG. 13 is depicted, showing the additional intermediate conduits (50A), with additional internal passageways (53A) secured (149) to the upper exit chamber housing (154) and with bushing mills (124A) and thrust bearings (125A) engaged about the additional conduits (50A) for forming a radial bushing blade (111A). The radial bushing blade (111A) is shown meshing with adjacent bushing mills and thrust bearings forming adjacent radial bushing blades (111A) to create a rock breaking aperture (148) member, between bushing mills and thrust bearings.

In FIG. 15, a magnified detail view of a portion of the bladed bushing mill (57A) within line D of FIG. 13, is shown and depicts the additional intermediate conduits (50A) with additional internal passageways (53A) and a service engagement (150) to the lower exit chamber housing (155). The Figure shows bushing mills (124A) and thrust bearings (125A) engaged about the additional conduits (50A) for forming a radial bushing blade that can mesh with an adjacent radial bushing blade to create an aperture (148), between the independently rotating bushing mills and thrust bearings.

The example service connector (150) shown, is rotatable via receptacles (151) for a wrench to connect and disconnect the lower exit chamber housing (155) via threads (153) engaged with the additional conduits (50A) so that worn bushing mills and thrust bearings can be replaced to allow reuse of rock breaking tool embodiments. Any service suitable for down hole tools is applicable to rock breaking apparatus of the present inventor.

Referring now to FIGS. 16 to 22, comprising member embodiments of the bladed bushing mill (57A) of FIG. 11, showing exit chamber housings (154, 155), additional conduits (50A) with service engagement connectors (152, 153, also shown in FIG. 15), and bushing mills (124) and thrust bearings (125) that are stackable and rotatable about the additional conduits (50A), wherein replacement of said bushing mills and thrust bearings can be facilitated by a service member (150) to create tool embodiments that are re-usable when components become worn.

Referring now to FIGS. 16 and 17, isometric views with dashed lines showing hidden surfaces of the upper and lower exit chamber junction member embodiments (154 and 155, respectively) of the bladed bushing mill of FIG. 11, are depicted as angled to illustrate engagement connections for additional conduits (50A of FIG. 18), to connect additional internal passageways (53A).

Referring now to FIGS. 18 and 19, an isometric view, with dashed lines showing hidden surfaces of a full and magnified partial view within detail line E, respectively, of additional internal conduit (50A) member embodiments (155A) associated with the bladed bushing mill of FIG. 11, is shown. The Figure shows the additional internal passageways (53A) and example threaded connectors (153).

FIG. 20, an isometric view of a stackable milling bushing (124) member embodiment (124A), used in the bladed bushing mill of FIG. 11, is shown. The Figure illustrates impact surfaces (123) on low profile circumferential blades (111) usable to impact rock debris to increase the volume of reduced particle size rock debris used or removed from a subterranean passageway.

Referring now to FIG. 21, an isometric above an elevation view of a thrust bearing (125) member embodiment (125A) used in the bladed bushing mill of FIG. 11, is depicted. The Figure shows impact surfaces (123) against which a stackable bushing mill (124 of FIG. 20) can form an aperture (148 of FIGS. 11 to 15).

FIG. 22, an isometric view of a service connector member embodiment (150) is shown, associated with the bushing mill of FIG. 11. The Figure depicts an example threaded (153) connection that is associated with threads (153 of FIG. 19) of another member and rotated using a wrench and receptacles (151), wherein another rotatable connector (152) is engagable to the ends of a exit chamber junction (155 of FIG. 17). When components, such as the bushing mills (124 of FIG. 20) and thrust bearings (125 of FIG. 21), become worn the service connection can be used to replace worn components.

Service connector members are usable with all rock breaking tools of the present inventor to facilitate repair and replacement of components, thus allowing said tools to be re-used.

Referring now to FIGS. 22A and 22B, an isometric view with line Q and a magnified isometric view of the motor assembly embodiment (155B) contained within line Q of FIG. 22A, respectively, is shown. The Figures depict a rotating housing (158A) with the inside profile of a stator disposed about a rotor shaped assembly (157), fixable to a conduit, wherein the motor member (155) can be usable to rotate apparatus, such as the bushing mill (124 of FIGS. 27 to 29) with splines (91) on its circumference corresponding to splines on rotated apparatus.

Alternative embodiments of the bladed bushing mills (57A and 57B) of FIGS. 11 and 23 can be formed by replacing the additional conduits (50A of FIG. 18) with the rotating additional wall (51A) embodiment (155B), wherein fluid passing through the arrangement acts as a fluid motor (156A) for rotating bushing mills and/or thrust bearings engaged to the circumferential splines (91). In this motor embodiment, using a positive displacement fluid motor, a limited amount of fluid circulation can occur through the additional internal passageway (53A) until sufficient flow occurs to force fluid between the rotor shaped and stator shaped surfaces to rotate the housing and, subsequently, any apparatus engaged to the rotating housing (158A), depicted for illustration purposes as spline (91) engagements.

Referring now to FIGS. 23 to 26, illustrating an embodiment of a motorized bladed bushing mill (57B) with a motorized central arrangement disposed within radial bushing mill blades (111B), with intermediate apertures (148) for engaging and breaking rock debris.

The motorized central bushing mill of this embodiment, or alternative embodiments using motorized additional passageways (53A) described in FIGS. 22A and 22B, are usable to aggressively operate apertures (148) in the engagement of cutting beds on the lower side (144 of FIGS. 3 and 4) of a passageway or to create turbulent and tortuous pathways through a reduced cross section (e.g. between 17 and 140 of FIG. 2) for capturing and breaking larger rock debris within said apertures (148), which can further increase the volume of reduced particle size rock debris for use within or removal from the subterranean passageway.

Energy used to operation one or more motor driven rock breaking tool embodiments is at least partially offset by more effective removal of rock debris avoiding the slip stream effect described in FIG. 2 or cuttings beds described in FIGS. 3 and 4, within a strata bore of improved pressure integrity described in FIG. 2.

Dependent on the hardness of rock debris, aggressive impacting surfaces (123 of FIG. 27-29), comprising, for example, hardened inserts or PDC cutters, can be used with driven bushing mills (124C of FIG. 27-29) to better cut or break rock debris so that it can be used or removed more effectively.

Additional embodiments may be formed for dual conduit or managed pressure conduit string assemblies (49 of FIG. 6) by engaging an internal conduit (50 of FIG. 6) to the rotor (157), at upper and lower ends, to create a continuous internal passageway (53) with an additional annular passageway using passageways within the radial additional conduits. Further, embodiments may be formed by replacing the radially disposed blades with a single eccentric blade of fixed or rotation bushing type to reduce the outside diameter requirements of a dual conduit string adaptation.

FIG. 23, a plan view of an embodiment of a motorized bladed bushing mill with section line F-F associated with FIG. 24, is shown and depicts the assembly within a passageway through subterranean strata (52) having a first annular passageway (55), where radial blades (111B), comprised of rotatable bushing mills, form an aperture (148) member for aggressively engaging and breaking rock debris, when the motorized bushing mill radial blades are rotated within the passageway. The fluid motor driving a central bushing mill creates an additional aperture by rotating the central bushing mill in the same or opposite direction to the bushing mills on the radial blades (111B), that are engaged with the strata wall and rotated in a relative sense by rotation of the deploying conduit string, to engage and churn cuttings beds for capturing and breaking rock debris.

FIG. 24, an elevation cross sectional view along line F-F of FIG. 23, with the strata removed and with breaks indicating portions of the tool that have been removed, is shown. The Figure depicts the internal passageway (53A), that is located between upper (154) and lower (155) exit chamber junctions with a fluid motor, herein shown for illustration purposes as a positive displacement motor with a rotor (157) within a stator (158), having a torque dampening engagement (159) driving a central stacked bushing member embodiment, with an engaging rock breaking aperture (148) between bushing mills, thrust bearings and/or the strata wall.

Referring now to FIG. 25, an isometric view, with detail line G associated with FIG. 26, having the strata and the portion of the motorized bladed bushing mill (57B) along line F-F of FIG. 23 and break lines of FIG. 24 removed, is shown. The Figure illustrates a motor arrangement (156B) engagable to a conduit string at the upper end and a rotary connection (72) at the lower end.

Referring now to FIG. 26, a magnified detail view of a portion of the motorized bladed bushing mill within line G of FIG. 25 is depicted, showing the internal passageway (53) passing through the splined (91) rotating central conduit (51A) engaged to the rotor (157 of FIG. 25) with a torque dampening connection (159 of FIG. 25), wherein stackable bushing mills (124B and 124C) together with thrust bearings (125B) form aggressive rock breaking apertures (148), between the central motorized bushing assemblies and the radial blade (111B) bushing assemblies.

Referring now to FIGS. 27, 28 and 29, a plan view, elevation view and isometric projected view, respectively, of a milling bushing member embodiment are shown. The Figures illustrate a rotatable impact surface arrangement for motorized bushing mill assemblies to orient impact surfaces (123), for example PDC cutters, with splines (91) to rotate and an aperture to further increase the volume of reduced particle size rock debris for use within, or removal from, the subterranean passageway.

Referring now to FIGS. 30 to 33 and FIGS. 34 to 35, illustrating a motorized rock slurrification embodiment (65A) and associated bladed (111) member embodiments, respectively, within a bore through subterranean strata. In the Figures, an open blade arrangement (160 of FIG. 35), for engagement with the strata wall, is disposed about a motor (156C) driven internal bladed impellor (160A of FIG. 34) with further impact surfaces (123 of FIG. 34), shown as PDC cutters, oriented to pump from and break rock within its apertures (148), between the motorized impellor (160A), open blade arrangement (160) and strata wall, used to increase the volume of reduced particle size rock debris or remove from the passageway through subterranean strata.

The motorized rock slurrification tool (65) is usable to aggressively operate apertures (148) when engaged with cutting beds on the lower side (144 of FIGS. 3 and 4) of a passageway or when turbulent and tortuous pathways, through a reduced cross section (e.g. between 17 and 140 of FIG. 2) are needed to capture and break larger rock debris. The energy used to operate the motor can be at least partially offset by this more effective removal of rock debris by avoiding the slip stream effect described in FIG. 2 and/or the cutting beds effect described in FIGS. 3 to 4.

Figures 30, 31, 32, 33, 34, 35, 36, 37, 38, 39:
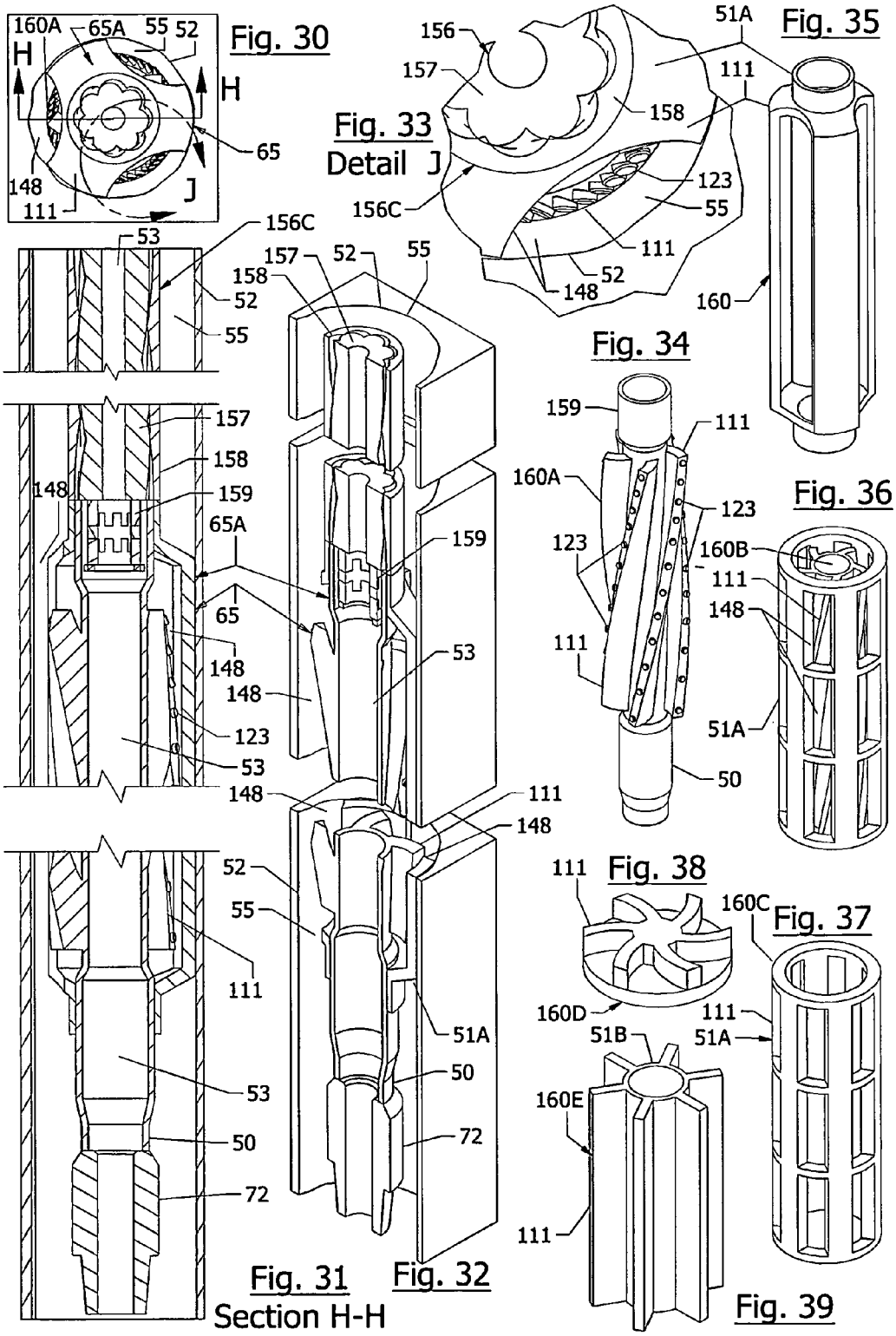

FIG. 30, a plan view of an embodiment of a motorized rock slurrification pump (65A) with section line H-H associated with FIG. 31 and detail line J associated with FIG. 33, shows the first annular passageway (55) between the tool and the strata passageway (52), wherein the impellor (160A) rotates through the aperture (148) between blades (111).

FIG. 31 depicts an elevation cross sectional view, along H-H of FIG. 30, of a motor (156C) member embodiment, which is depicted as a positive displacement mud motor with internal passageway (53) within the rotor (157). The rotor (157) is shown housed within a stator (158), rotating a torque dampening connector (159) engaged with the bladed impellor (160A of FIG. 34), having blades (111) oriented to both slurrify and pump debris from the bladed strata engagement stabilizing housing (160 of FIG. 35).

The additional wall (51A of FIGS. 33 and 35) bladed strata engagement member engages the strata wall on the right side of FIGS. 30 and 31, but has an open space corresponding to the aperture (148) on the left side of FIGS. 30 and 31, through which the impeller (160A of FIG. 34) rotates, affecting the first annular passageway (55), and using the motor arrangement (156C) for forming a tortuous moving rock breaking aperture to increase the volume of reduced particle size rock debris used within or removed from the bore hole.

Referring now to FIG. 32, an isometric projected view with a half of the strata wall removed, showing a slice of the motorized rock slurrification tool along line H-H of FIG. 30 and breaks associated with FIG. 31, is shown. The Figure illustrates the rotating aperture (148) created from the blades (111) of impellor and strata wall (52).

Referring now to FIG. 33, a magnified detail view of a portion of the motorized rock slurrification apparatus, within line J of FIG. 30, is depicted. The Figure shows the impeller impact surfaces (123) within the open face of the additional wall (51A) and blade (111) contact with the strata wall (52) for forming an aperture (148), through which the rotating impellor (160A of FIG. 34) creates turbulent flow, impacting and/or impelling larger rock debris against the strata wall or blade (111) of the additional wall (51A).

Referring now to FIGS. 34 and 35, isometric views of an impellor member embodiment (160A) and bladed housing member embodiment (160), respectively, for the motorised rock slurrification pump (65A) of FIG. 30, illustrating the open face between blades (111) engaged to the additional wall (51A) engagable with the impellor (160A) rotated by a torque dampening connector (159 of FIGS. 31 and 32) connected to the rotor (157 of FIGS. 31 and 32).

Referring now to FIGS. 34 to 39, illustrating member embodiments of bladed arrangements usable as additional walls or housings for internal impellors, usable within embodiments of the present invention.

FIG. 37 depicts an isometric view of the bladed housing member embodiment (160C) of the housing and impellor arrangement (160B) of FIG. 36. The Figure shows an open face arrangement, with supports between blades (111) for improved strength during downhole operation of the housing (160C).

Referring now to FIGS. 38 and 39, alternative adapted impellor member embodiments (160D and 160E, respectively) usable with other embodiments of the present invention are shown. The Figures illustrate that any form of impellor member can be usable to impact and/or impel rock debris for impacting surfaces within the subterranean bore or usable with rock breaking tools to increase the volume of reduced particle size rock debris for use or removal from said passageway.

FIG. 40, a plan view of a prior art planetary gearing arrangement (130), depicting a ring gear (161) disposed about planetary gears (162) and a sun gear (163) is shown. The gearing arrangement (130) can be usable with embodiments of the present invention to increase relative rotational speeds and associated impact breaking or impelling forces used to increase the volume of reduced particle size debris.

Referring now to FIGS. 41 to 56, various epicyclical gearing member embodiments (174, 175 and 176) within various rock slurrification tool (65) embodiments are depicted. In the Figures, the member embodiment (174) represents the ring gear (161) frictionally engaged to the strata wall, the member embodiment (175) represents the planetary gears (162) frictionally engaged to the strata wall, or the member embodiment (176) represents the sun gear (163) frictionally engaged to the strata wall (52).

Gearing ration arrangements (130 of FIGS. 41 to 56) are usable to increase the volume of reduced particle size rock debris generated by increasing the frequency of impact and associated breakage of said rock debris, per revolution of the carrying conduit string or per volume of fluid slurry circulated, if the gearing is engaged to a fluid motor.

For illustration purposes, the present description depicts planetary gearing or epicyclical gearing arrangements, but any gearing arrangement suitable for downhole deployment is equally applicable to the present invention.

Referring now to FIGS. 41 to 43, an epicyclical gearing member embodiment (174) is shown, wherein a conduit string (50) is engaged with, and rotates, planetary gears (162), which act against the ring gear (161) in frictional engagement with the strata wall (52) to turn the sun gear (163) and rotate an impellor for hurling rock debris toward an impact surface and/or forming an aperture for engaging and breaking rock debris.

FIG. 41, a plan view of a slice taken perpendicular to the longitudinal axis of a bore hole of an embodiment (65B) of a rock slurrification tool (65) using a gearing (130) arrangement within the subterranean strata is shown. The Figure illustrates blades (111), with frictional contact to the passageway through subterranean strata (52), for forming a first annular passageway (55) between said blades with, a ring gear (161), that can be secured to said blades and anchored frictionally to the strata wall. The internal passageway (53) from the conduit string (50) can be diverted about gears of the gearing arrangement (130) in any manner, such as that shown in FIGS. 44 to 45 for example.

Referring now to FIG. 42, a plan view sliced perpendicular to the longitudinal axis of a borehole showing an embodiment (65C) of rock slurrification tool (65) using a gearing arrangement (130) within the subterranean strata, usable with dual strings and managed pressure conduit strings (49 of FIG. 6) is depicted. The Figure illustrates blades (111), frictionally engaged to the passageway through subterranean strata (52) with an additional wall (51A), secured between a ring gear (161) and the blades (111), that, together with the strata wall, form the first annular passageway (55). The internal passageway (53) from the conduit string (50) is diverted around gears of the gearing arrangement (130) to a passageway disposed about the ring gear (161), wherein the additional annular passageway (54) has been divided to accommodate additional annular passageway (54) flow and the temporary diversion of the internal passageway (53) around the gears (53E), using, for example, an adapted member similar to other member embodiments described herein (172A of FIGS. 44-45 and 172 of FIGS. 46-47).

FIG. 43, a plan view, with dashed lines showing hidden surfaces of a slice perpendicular to the longitudinal axis of the bore hole, with section line K-K associated with FIG. 45, of an embodiment (65D) of rock slurrification tool (65) within the subterranean strata passageway (52) is shown. The Figure illustrates blades (111), frictionally engaged to the passageway (52) with an additional wall (51A) secured between blades (111), that, together with the strata wall, form the first annular passageway (55).

The internal passageway (53) from the conduit string (50) is diverted around the gearing arrangement (130) through an additional internal passageway (53B) disposed about the ring gear, wherein the rock slurrification intake passageway (127) and discharge passageway (129) are disposed within blades (111).

In FIG. 44 an isometric cross sectional view along line K-K of FIG. 43, with detail line L associated with FIG. 45 and an unsliced impellor (160B of FIG. 45), depicts the embodiment (65D) of a rock slurrification tool (65) disposed within the subterranean passageway (52) and surrounded by the first annular passageway (55), wherein the internal passageway (53) is diverted through a flow diverter (172A) to the additional internal passageway (53B, shown in FIG. 45) before returning to the internal passageway of the conduit string (50).

Referring now to FIG. 45, a magnified detail view of a portion of the rock slurrification tool within line L of FIG. 44 is depicted, showing flow diversion (166) from the upper internal passageway (53) through the additional internal passageway (53B) and back into the lower internal passageway (53) around the gearing arrangement (130). The gearing arrangement (130) includes a planetary gears (162) engaged with and rotated by the conduit string against a ring gear (161), frictionally anchored to the strata via the blade, to rotate a sun gear (163) and engaged impellor (160B) thru the gearing ratio, defined by the teeth of the gears turning blades that impel rock debris against impact surfaces to increase the volume of reduced particle size rock debris, using an impellor similar to above ground rock slurrification pumps.

The slurrification intake passageway (127) feeds slurry to the impellor (160B) that expels a slurrified rock slurry from the discharge passageway (129 of FIG. 43).

Referring now to FIGS. 46 to 51, a rock slurrification tool (65) embodiment (65E) for a single conduit string application is depicted. In the Figures, the geared impellor member embodiment (167) is operated by an engaged conduit string and/or motor, wherein the gearing ratio increases from the engagement at the top of the member to the impellor, after which the gearing ratio decreases from the impellor to the member for returning to the rotational speed of the top engagable conduit at the lower engagable conduit.

Within subterranean boring operations, low speed high torque tools are often better than high speed low torque tools, especially when PDC rock cutting technology is used. When increasing the rotational speed of an impellor relative to the rotational speed of the conduit string to increase the volume of reduced particles size rock debris generated, it is often desirable to return the rotation of the conduit string impellor to the original speed of the conveying conduit string.

Any subterranean deployable gearing arrangements causing speed increases/reductions above and/or below an impellor are usable with embodiments of the present invention to increase the frequency of impact and associated breakage of said rock debris, without adversely affecting the rotational speed of string components above and below embodiments of the present invention.

Figures 46, 47, 48, 49, 50, 51:
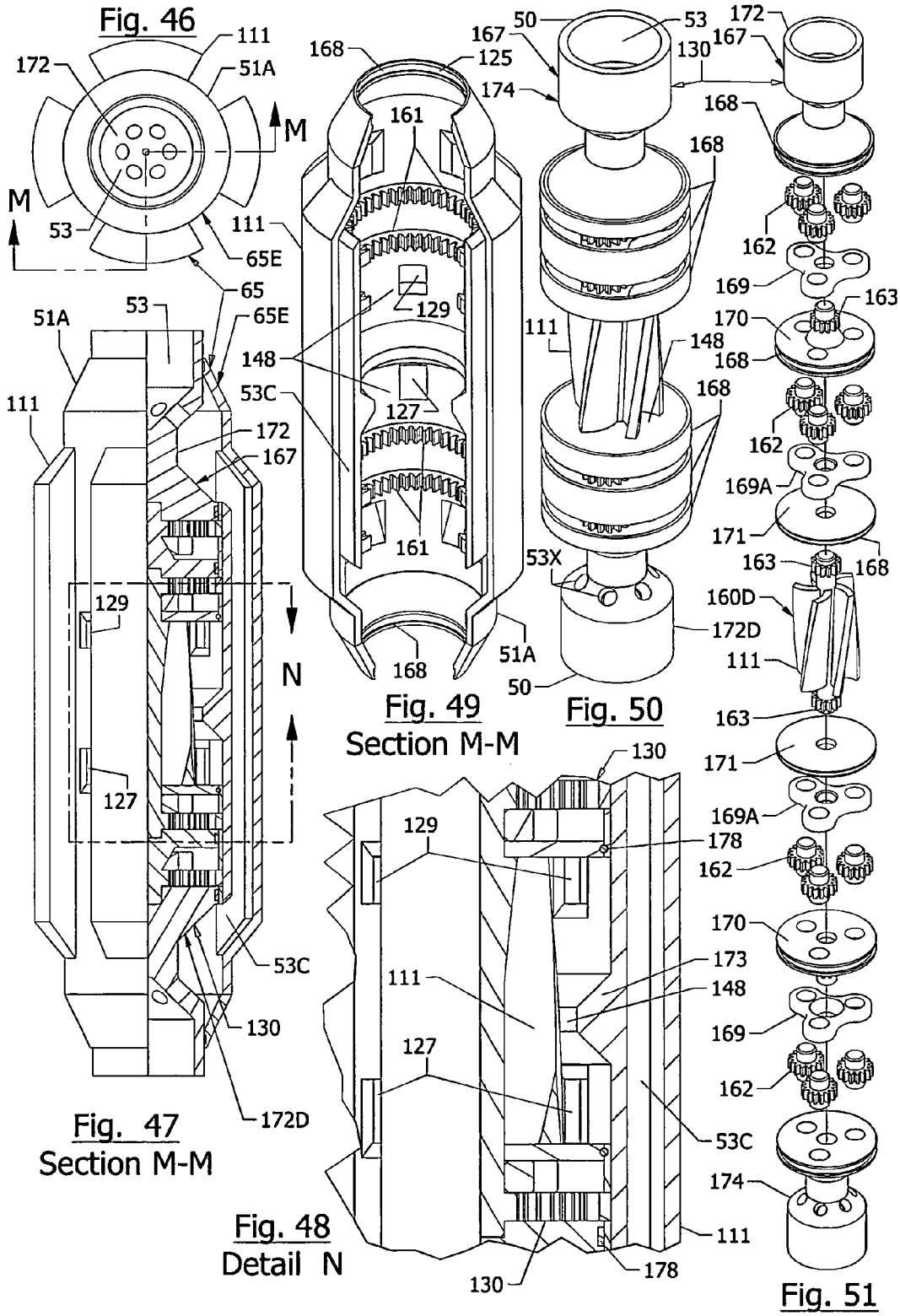
FIGS. 46 to 48 depict an embodiment of a rock slurrification tool with the planetary gearing member embodiment of FIGS. 50 and 51 used to increase the speed passed from the upper rotational conduit to the impellor, after which the rotational speed is reduced from the impellor to the lower rotational conduit.
FIGS. 49 to 51 illustrate various member embodiments used in the rock breaking tool embodiment of FIGS. 46 to 48.

FIG. 46, depicts a plan view of an embodiment (65E) of a rock slurrification tool (65) with section line M-M associated with FIGS. 47 and 49. The Figure shows blades (111) disposed about an additional conduit (51A), with the internal passageway (53) diverted around the gearing arrangement (130 of FIG. 47) through an additional internal passageway (53C of FIGS. 47-49).

FIG. 47 depicts an elevation cross sectional view along line M-M of FIG. 46, with detail line N associated with FIG. 48, showing the additional conduit (51A) with blades (111), fluid slurry intakes (127) and discharges (129) surrounding an inner gear and impellor arrangement (167), having a gearing arrangement (130). The gearing arrangement (130) can drive an impellor between the upper (172, also shown in FIG. 46) and the lower (172D) internal passageway (53) flow diverters, used to divert internal flow to an additional internal passageway (53C).

Referring now to FIG. 48, a magnified detail view of a portion of the rock slurrification tool (65) within line N of FIG. 47 is depicted. The Figure shows the gearing arrangements (130), above and below the blade (111) of an impellor, used to slurrify a mix of rock debris and fluid from the intake (127) and, then, expelling it through the discharge (129). A fluid intake member (173) centralizes the intake of rock debris and fluid forming an aperture (148) between the impellor housing wall and the blade (111) of the impellor. Internal flow is diverted through the additional internal passageway (53C), passing through the blade of the additional walls around the gearing arrangement (130) using bearings (178) and races to improve operational efficiency.

FIG. 49 depicts an isometric cross sectional view along line M-M of FIG. 46, showing the bladed (111) housing which surrounds the gearing embodiment (167 of FIGS. 47 and 50), comprising an additional wall (51A) with blades (111) containing an additional internal passageway (53C). The Figure shows a race (168), for associated bearings, that forms a thrust bearing (125) at upper and lower ends. When placed within the passageway through subterranean strata, the blades anchor the ring gears (161) above and below the slurrification intakes (127) and discharges (129).

FIG. 50 depicts an isometric view of the member embodiment (167), within the slurrification tool (65) of FIGS. 46 to 48 associated with the exploded isometric view of FIG. 51. The Figure illustrates races (168) of a gearing arrangement (130) between upper and lower conduits (50) for forming part of the inner portion of the upper (172) and lower (172D) flow diverter member, with orifices (53X) from the internal passageway (53) to the additional passageway (53A of FIGS. 47-49) and an impellor with blades (111).

Referring now to FIG. 51, an exploded isometric view of the gearing arrangement (130) of FIG. 50 with the outer races (168 of FIG. 50) not shown, is depicted. The Figure illustrates a series of embodiments of planetary gear (163) members, yoke members (169, 169A), sun gear (163), gearing members (170), isolation plates (171), and further sun gears (163) engaged with an impellor member (160D) with blades (111) between upper (172) rotatable and lower (172D, as shown in FIG. 50) rotatable flow diverters, that can be engagable with a conduit string and/or motors. When the upper flow diverter rotates the series of gears that increase the ratio of impeller rotations to conduit string and/or motor rotations, thereafter the ratio of impellor rotations to conduit string and/or motor rotations is decreased until reaching the lower flow diverter. Various members have races (168) that can be associated with races (168) of FIG. 50, wherein intermediate bearings are placeable to increase the efficiency of the gearing rotational ratios.

Referring now to FIGS. 52 to 54, and 55 showing a portion of an embodiment (65F) of a rock slurrification tool (65) and flow diverter member embodiment (172B), respectively, wherein the conduit (50) drives the ring gear (161), and the planetary gear (162) shafts are engaged to the additional conduit (51A) blades (111) in frictional contact with the strata wall, during use and for forming a frictionally anchored planetary gear member embodiment (175).

Figure 52:
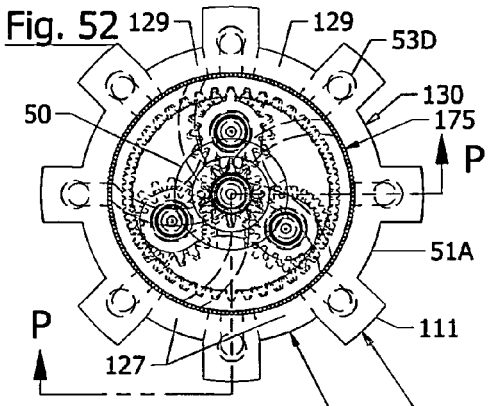
FIGS. 52 to 54 illustrate a portion of a rock slurrification tool embodiment usable with various gearing member arrangements.
Figure 54:
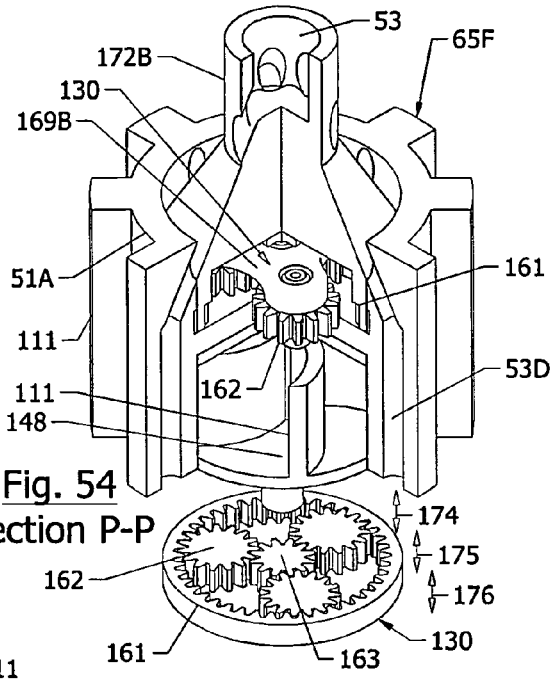
Figure 53:
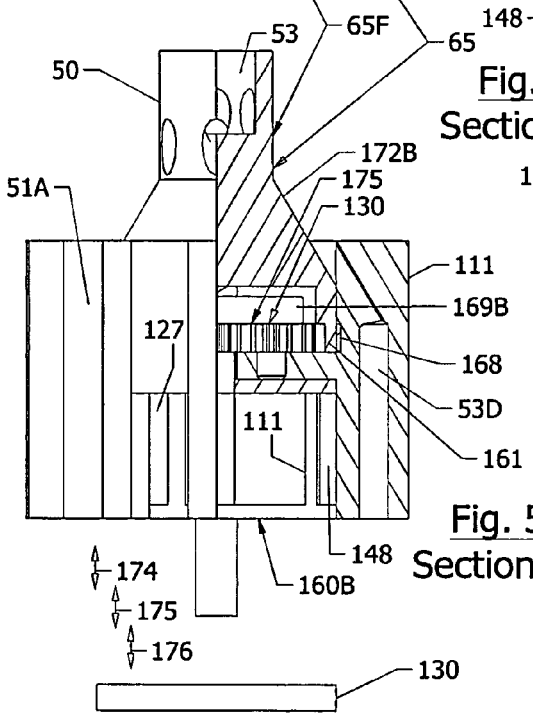

Referring now to FIG. 52, a plan view with dashed lines showing hidden surfaces of a portion of rock slurrification tool (65) with section line P-P associated with FIGS. 53 and 54, is shown. The Figure shows additional internal passageways (53D) within blades (111) disposed about a gearing arrangement (130) of a member gearing embodiment (175), wherein the conduit (50) rotates the ring gear (161 of FIG. 55) against planetary gears engaged with the additional conduit wall (51A) and blades (111) subject to frictional engagement with the strata wall during use.

Dashed lines show the area of the additional conduit wall (51A) for fluid slurring intakes (127) and discharges (129).

Figure 55:
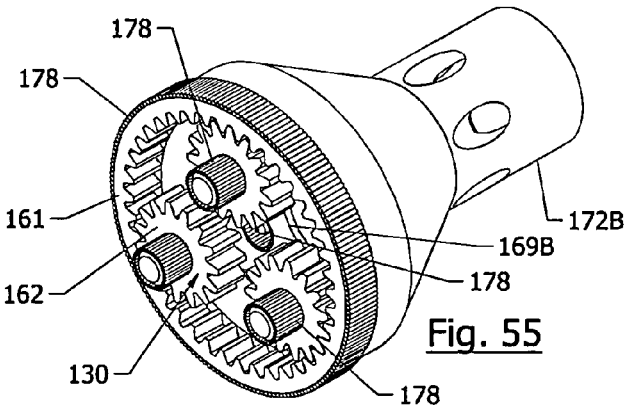
FIG. 55 shows internal members of the partial rock breaking apparatus of FIGS. 52 to 54.

FIG. 53, an elevation cross sectional view along line P-P of FIG. 52, with no conduit above or below the blades (111) revealing the upper flow diverter (172B) shown in FIG. 55, is shown. The Figure depicts orifices for passageways through the string conduit (50) internal passageway (53) to the additional internal passageways (53D), that will later be diverted back to the internal passageway through a lower flow diverter once the gearing arrangement has been bypassed. Blades (111) of the impellor (160B), aperture (148) and the fluid slurry intake (127) are visible.

A shaft extends from the lower end of the rock slurrification tool (65), additional wall (51A), blades (111) and impellor (160B) that originates from the sun gear, wherein the shaft and other enageable surfaces on the lower end are usable with other ring gear frictional engagements (174), planetary gear frictional engagements (175), or sun gear frictional engagements (176) with the strata wall to increase or decrease gearing ratio arrangements.

Referring now to FIGS. 54 and 55, an upper flow diverter member embodiment (172B) within a rock slurrification tool (65) and in isolation, respectively, is shown. The depicted embodiments include a ring gear (161) that drives planetary gears (162), engaged to the additional wall (51A) through the lower end of the planetary gear shaft with the upper shaft end of the planetary gear shaft engaged to a yoke (169B, shown in FIGS. 53 and 54), and the sun gear engaged between the planetary gears.

Rotation of the conduit string (50) rotates the ring and acts against the planetary gears that, through their engagement with the additional wall (51A), have a frictional engagement with the strata wall during use causing rotation of the conduit string and ring gear to rotate the sun gear that rotates the impellor blades (111) to slurrify rock debris.

Referring now to FIG. 54, an isometric cross sectional view along line P-P of FIG. 52, wherein the impellor is not sliced, is shown. The Figure illustrates the upper flow diverter (172B), associated with FIG. 55, above an epicyclical gearing arrangement (130), whereby members located below can have the ring gear frictionally anchored (174), the planetary gears frictionally anchored (175) or the sun gear frictionally anchored (176) to the strata wall during use to create a plurality of gearing arrangements, that can be usable to increase rotational speeds of rock breaking impacts used to increase the volume of reduced particle size rock debris produced.

In FIG. 55, an isometric view of an embodiment of the gearing and upper flow diverter member embodiment (172B) of the rock slurrification tool of FIGS. 52 to 54, is show. The Figure shows bearings (178) disposed about the geared flow diverter, sun gear shaft socket within the yoke (169B), and on the lower end planetary gear (162) shafts. All forms of bearing and races suitable for rotation of downhole apparatus are usable for embodiments of the present invention.

Figure 56:
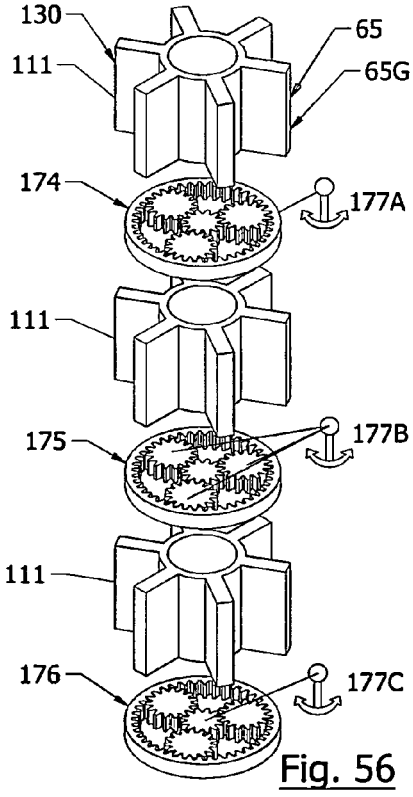
FIG. 56 depicts the various anchoring arrangements for planetary gearing and stacked bladed impellor members usable to construct other preferred embodiments of the present invention.

Referring now to FIG. 56, an isometric conceptual view of stacked gearing member embodiments (174, 175 and 176) usable with other embodiments of the present invention, are shown. FIG. 56 shows the embodiments (174, 175, and 176) having impellors with blades (111), wherein the gearing arrangement (130) can include a plurality of gears using an epicyclical gearing member (174) ring gear frictionally anchored (177A) to the strata wall, the gearing member (175) planetary gears frictionally anchored (177B) to the strata wall, or the gearing member (176) sun gear frictionally anchored (177C) to the strata wall, to, in use, rotate members at varying speeds and directions according to the gearing ratios and engagements between members, gears and the strata wall. While impellor are shown for ease of illustration, any rock breaking tool member can be turned by gearing arrangements to improve its efficiency.

As demonstrated in FIGS. 6 to 56, embodiments of the present invention provide members and methods that enable any configuration or orientation of impact surface (123), milling profile (123A), stackable mill (124), thrust bearing (125), gearing arrangement (130), motor, impellor, and/or bladed (111) arrangement deployable within a passageway through subterranean strata to increase the volume of reduced particle size rock debris and/or form an aperture (148) usable to further increase the volume of reduced particle size rock debris, used within and/or removed from a passageway through subterranean strata.

While various embodiments of the present invention have been described with emphasis, it should be understood that within the scope of the appended claims, the present invention might be practiced other than as specifically described herein.

The invention claimed is:

1. A method for using rock debris or removing unused rock debris from a bored passageway through subterranean strata using at least one rock breaking apparatus, said method comprising the steps of:

providing a fluid slurry communicated toward a lower end of at least one conduit string placed within a proximal region of an unlined portion of said passageway through subterranean strata containing an inventory of rock debris;

circulating said fluid slurry from said proximal region to urge at least a portion of said inventory of rock debris for use within or removal from said passageway through subterranean strata;

and providing said at least one rock breaking apparatus engaged with said at least one conduit string and placed in said proximal region of an unlined portion of said passageway through subterranean strata with at least one member adapted to increase a volume of reduced particle size rock debris generated by increasing a frequency of impact and an associated breakage of said inventory of rock debris within said proximal region per revolution of said at least one conduit string, per volume of fluid slurry circulated, or combinations thereof, wherein a used volume of rock debris coats an unlined strata wall of said passageway to inhibit strata fracture initiation or propagation and an unused volume of rock debris is urged from an upper end of said passageway at an increased rate by an associated reduction in fluid slurry suspension or velocities to urge said reduced particle size rock debris from said passageway, through said unlined portion having an improved pressure integrity produced from inhibiting said initiation or propagation of strata fractures.

2. The method according to claim 1, wherein said at least one member is arranged to engage rock debris through an aperture used to engage, break, impel, or combinations thereof, said rock debris against surfaces of said at least one rock breaking apparatus, a wall of said passageway through subterranean strata, or combinations thereof.

3. The method according to claim 2, wherein said at least one member further comprises one or more additional stacked milling bushing members, thrust bearing members, eccentric rotating blades, blades having impact surfaces, impact profiles, gearing assemblies, motors, or combinations thereof, that become angularly offset during rotation to affect the aperture used to engage, break, impel, or combinations thereof, said rock debris.

4. The method according to claim 3, wherein said eccentric rotating blades, blade impact surfaces, impact profiles, gearing assemblies, motors, or combinations thereof, are arranged in use to pump said fluid slurry to urge said rock debris axially along said passageway through subterranean strata to further increase rate of use or rate of removal of said rock debris.

5. The method according to claim 1, wherein providing said at least one rock breaking apparatus comprises rotating or driving said at least one member, placed concentrically or eccentrically to said at least one conduit string, by contact with said unlined strata wall, one or more additional members, one or more conduit strings, one or more gearing arrangements, one or more motor arrangements, or combinations thereof.

6. The method according to claim 1, wherein an axially disposed motor, a radially disposed motor, or combinations thereof, are engaged to said at least one conduit string and used to rotate at least one additional member, wherein internal motor components rotate relative to a motor housing engaged to said at least one conduit string, the motor housing rotates relative to the internal motor components engaged to said at least one conduit string, or combinations thereof, to increase impact engagement with said rock debris and to increase said associated breakage and said volume of reduced particle size rock debris generated per revolution of said at least one conduit string, per volume of fluid slurry circulated, or combinations thereof.

7. The method according to claim 1, wherein circulating said fluid slurry comprises diverting circulation from the passageway through subterranean strata to at least one additional internal passageway to form an axial aperture, place an axially disposed motor, drive a radially disposed motor, or combinations thereof.

8. The method according to claim 1, wherein at least one gearing assembly is used to increase the rotational speed of at least one additional member relative to said at least one conduit to increase impact engagement with said rock debris and to increase said associated breakage and said volume of reduced particle size rock debris generated per revolution of said at least one conduit string, per volume of fluid slurry circulated, or combinations thereof.

9. The method according to claim 8, wherein said at least one gearing assembly first increases rotational speed then decreases rotational speed of said at least one additional member relative to said at least one conduit string.

10. The method according to claim 8, wherein said at least one gearing assembly first decreases rotational speed then increases rotational speed of said at least one additional member relative to said at least one conduit string.

11. The method according to claim 1, wherein said at least one member is provided with fixed engagements or service engagements for disassembling and replacing rotating or worn members, thereby forming reusable rock breaking tools.

* * * * *